US008532534B2

(12) United States Patent
Taniguchi et al.

(10) Patent No.: US 8,532,534 B2
(45) Date of Patent: Sep. 10, 2013

(54) CHARGING MEMBER, PROCESS CARTRIDGE, AND ELECTROPHOTOGRAPHIC APPARATUS

(75) Inventors: Tomohito Taniguchi, Suntou-gun (JP); Satoshi Koide, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/217,500

(22) Filed: Aug. 25, 2011

(65) Prior Publication Data

US 2011/0305481 A1 Dec. 15, 2011

Related U.S. Application Data

(63) Continuation of application No. PCT/JP2011/002340, filed on Apr. 21, 2011.

(30) Foreign Application Priority Data

Apr. 30, 2010 (JP) ..... 2010-105842

(51) Int. Cl.
*G03G 15/02* (2006.01)

(52) U.S. Cl.
USPC ..... 399/176

(58) Field of Classification Search
USPC ..... 399/174, 176, 313; 492/17, 18, 492/30, 37; 361/225
See application file for complete search history.

(56) References Cited

U.S. PATENT DOCUMENTS 6,184,300 B1 * 2/2001 Shimokawa et al. ..... 525/242
7,283,304 B2 * 10/2007 Murata et al. ..... 359/599
7,869,741 B2 1/2011 Mayuzumi et al.
2004/0265006 A1 12/2004 Taniguchi et al.
2010/0135695 A1 6/2010 Mayuzumi et al.
2011/0044725 A1 2/2011 Mayuzumi et al.

FOREIGN PATENT DOCUMENTS

JP 09-258523 A 10/1997
JP 2002070839 A * 3/2002
JP 2005-037931 A 2/2005
JP 2005-274768 A 10/2005
JP 2008-276026 A 11/2008
JP 2009009029 A * 1/2009
JP 2009075497 A * 4/2009
JP 2009237042 A * 10/2009
WO 2010-050615 A1 5/2010

OTHER PUBLICATIONS

International Search Report dated May 25, 2011, issued in PCT/JP2011/002340.
International Preliminary Report on Patentability dated Nov. 15, 2012, in International Application No. PCT/JP2011/002340.

* cited by examiner

*Primary Examiner* — Robert Beatty
(74) *Attorney, Agent, or Firm* — Fitzpatrick, Cella, Harper & Scinto

(57) ABSTRACT

A charging member includes a conductive substrate and a conductive resin layer. The conductive resin layer includes a binder, conductive fine particles, and bowl-shaped resin particles each of which has an opening. The bowl-shaped resin particles are contained in the conductive resin layer in such a way as not to be exposed to an outer surface of the charging member, and the surface of the charging member has concavities derived from openings of the bowl-shaped resin particles and protrusions derived from edges of the openings of the bowl-shaped resin particles. The bowl-shaped resin particles each has a roundish concavity and includes inner walls lined with the conductive resin layer.

18 Claims, 4 Drawing Sheets

CHARGING MEMBER, PROCESS CARTRIDGE, AND ELECTROPHOTOGRAPHIC APPARATUS

CROSS-REFERENCE TO RELATED APPLICATIONS

This application is a continuation of International Application No. PCT/JP2011/002340, filed Apr. 21, 2011, which claims the benefit of Japanese Patent Application No. 2010-105842, filed Apr. 30, 2010.

BACKGROUND OF THE INVENTION

1. Field of the Invention

This invention relates to a charging member, a process cartridge and an electrophotographic apparatus.

2. Description of the Related Art

Japanese Patent Application Laid-open No. 2008-276026 discloses, as a charging member which is brought into contact with an electrophotographic photosensitive member to charge the electrophotographic photosensitive member electrostatically, a charging member having on its surface protrusions derived from conductive resin particles. Then, it discloses that such a charging member can keep any dot-like or horizontal line-like image defects from occurring on electrophotographic images; the defects being caused by stains of a toner, external additives and the like having come deposited on the surface of the charging member.

SUMMARY OF THE INVENTION

However, when the charging member according to Patent Literature 1 is used in contact charging, it has come about that the surface of the electrophotographic photosensitive member comes to wear non-uniformly as a result of its long-term service. Studies made by the present inventors on the reason therefor have revealed that, at the nip between the charging member and the electrophotographic photosensitive member, the pressure of contact therebetween concentrates at the protrusions derived from conductive resin particles of the surface of the charging member to make the surface of the electrophotographic photosensitive member scraped off non-uniformly.

Accordingly, the present invention is directed to providing a charging member that brings out stable charging performance over a long period of time and also makes the surface of the electrophotographic photosensitive member not easily come to wear non-uniformly. Further, the present invention is directed to providing a process cartridge and an electrophotographic apparatus that contribute to stable formation of high-grade electrophotographic images.

According to one aspect of the present invention, there is provided a charging member comprising a conductive substrate and a conductive resin layer, the conductive resin layer comprising a binder, conductive fine particles, and bowl-shaped resin particles each of which has an opening, the bowl-shaped resin particles being contained in the conductive resin layer in such a way as not to be exposed to the surface of the charging member, and the surface of the charging member having concavities derived from openings of the bowl-shaped resin particles and protrusions derived from edges of the openings of the bowl-shaped resin particles.

According to another aspect of the present invention, there is provided a process cartridge comprising the above charging member and an electrically chargeable body, both of which are integrally joined, and being so constituted as to be detachably mountable to the main body of an electrophotographic apparatus. According to a further aspect of the present invention, there is provided an electrophotographic apparatus comprising the above charging member, an exposure unit and a developing assembly.

According to the present invention, a charging member is obtained which can stably electrostatically charge the electrophotographic photosensitive member and also can keep the surface of the electrophotographic photosensitive member from coming to wear non-uniformly. According to the present invention, a process cartridge and an electrophotographic apparatus are also obtained which can stably form high-grade electrophotographic images.

DESCRIPTION OF THE EMBODIMENTS

Preferred embodiments of the present invention will now be described in detail in accordance with the accompanying drawings.

Figure 1A:
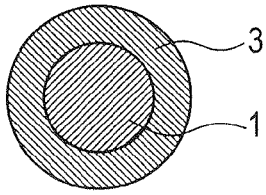
FIG. 1A is a sectional view showing an example of layer configuration of the charging member (roller shaped) according to the present invention.
Figure 1B:
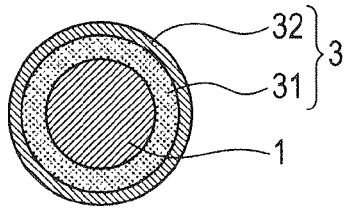
FIG. 1B is a sectional view showing another example of layer configuration of the charging member (roller shaped) according to the present invention.
Figure 1C:
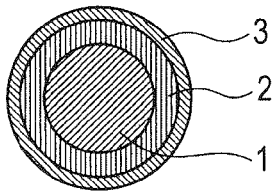
FIG. 1C is a sectional view showing still another example of layer configuration of the charging member (roller shaped) according to the present invention.
Figure 1D:
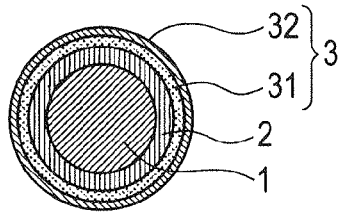
FIG. 1D is a sectional view showing a further example of layer configuration of the charging member (roller shaped) according to the present invention.

FIG. 1A shows a cross section of the charging member according to the present invention. The charging member has a conductive substrate 1 and a conductive resin layer 3 which covers the former on its peripheral surface. Then, the conductive resin layer 3 contains a binder, conductive fine particles and bowl-shaped resin particles. As shown in FIG. 1B, the conductive resin layer 3 may be formed of a first conductive resin layer 31 and a second conductive resin layer 32. As also shown in FIGS. 1C and 1D, a conductive elastic layer 2 may be formed between the conductive substrate 1 and the conductive resin layer 3.

Figure 2A:
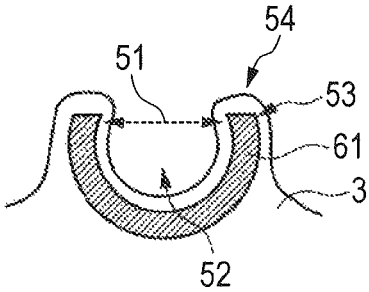
FIG. 2A is a partial sectional view showing an example of how the charging member according to the present invention is in the vicinity of its surface.
Figure 2B:
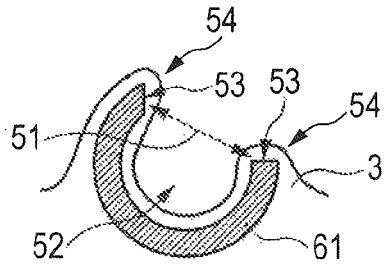
FIG. 2B is a partial sectional view showing another example of how the charging member according to the present invention is in the vicinity of its surface.

Conductive Resin Layer:

FIGS. 2A and 2B are enlarged sectional views of surface portions of the charging member according to the present invention. The conductive resin layer 3 as a surface layer is incorporated therein with bowl-shaped resin particles 61 standing unexposed to the surface of the charging member. Also, concavities 52 derived from openings 51 of the bowl-shaped resin particles and protrusions 54 derived from edges 53 of the openings of the bowl-shaped resin particles stand formed on the surface of the charging member.

Figure 2C:
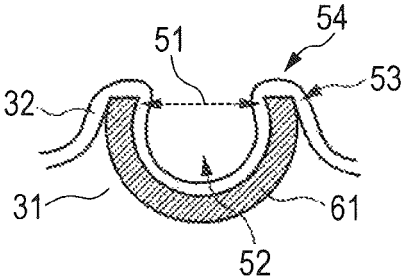
FIG. 2C is a partial sectional view showing still another example of how the charging member according to the present invention is in the vicinity of its surface.
Figure 2D:
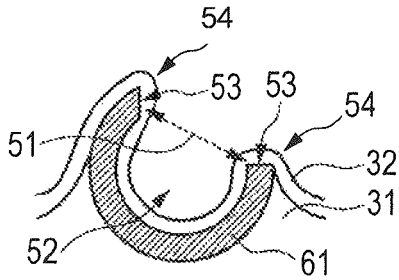
FIG. 2D is a partial sectional view showing a further example of how the charging member according to the present invention is in the vicinity of its surface.

FIGS. 2C and 2D show examples in which each conductive resin layer 3 is formed of the first conductive resin layer 31 and the second conductive resin layer 32. In the first conductive resin layer 31, bowl-shaped resin particles 61 are present in such a way that its openings are exposed to the surface of the first conductive resin layer 31 and edges of the openings constitute protrusions. The surface of such a first conductive resin layer is covered with the second conductive resin layer 32 so that the bowl-shaped resin particles 61 may stand unexposed to the surface. Then, the second conductive resin layer 32 is formed along inner walls of the bowl-shaped resin particles 61, and hence concavities derived from the openings of the bowl-shaped resin particles are formed on the surface of the second conductive resin layer constituting the surface of the charging member. Further, the second conductive resin layer covers the edges of the openings of the bowl-shaped resin particles 61, thus protrusions derived from the edges are formed on the surface of the second conductive resin layer.

It has been found that such a charging member the conductive resin layer of which is incorporated with the bowl-shaped resin particles standing unexposed to the surface and which has the concavities derived from the openings of the bowl-shaped resin particles and the protrusions derived from the edges of the openings can not easily scrape off the surface of the electrophotographic photosensitive member even as a result of its long-term service.

With regard to the charging performance, a finding has also been obtained such that charging performance is achieved which is at the same level as that of any charging members having the protrusions derived from resin particles.

That is, observations on how the charging member according to the present invention and the electrophotographic photosensitive member come into contact with each other and are rotated have revealed that the protrusions derived from the edges of the openings are kept in contact with the surface of the electrophotographic photosensitive member and the concavities derived from the openings have made empty spaces form inside the nip between the electrophotographic photosensitive member and the charging member.

Figure 8:
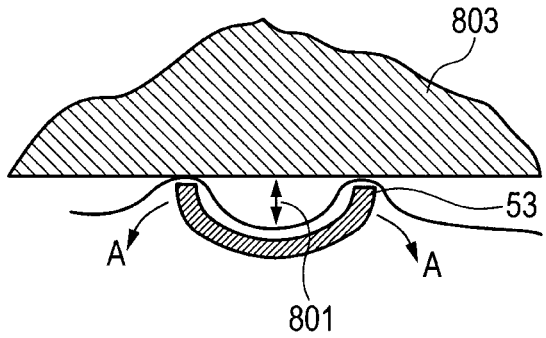
FIG. 8 is an enlarged view of the charging member according to the present invention and an electrophotographic apparatus in the vicinity of a nip between them.

It has further been ascertained that, compared with the protrusions derived from conventional conductive fine particles, the protrusions derived from the edges of the openings deform elastically at the time they come into contact with the surface of the electrophotographic photosensitive member. FIG. 8 is an enlarged diagrammatic view of a nip between the charging member according to the present invention and an electrophotographic photosensitive member. At the nip, the edges 53 of the openings of bowl-shaped resin particles 61 are considered to deform elastically in the directions of arrows A in virtue of the pressure of their contact with an electrophotographic photosensitive member 803. It is considered that the reason why the charging member according to the present invention can not easily scrape off the surface of the electrophotographic photosensitive member is that the pressure of contact that is to be applied to the electrophotographic photosensitive member stands lessened because the edges 53 of the openings of bowl-shaped resin particles have elastically deformed.

Further observations on how the charging member according to the present invention comes into contact with the electrophotographic photosensitive member at the nip between them have revealed that empty spaces are kept to form between the surface of the charging member and the surface of the electrophotographic photosensitive member also in the interior of the nip between the charging member and the electrophotographic photosensitive member (801 in FIG. 8). Through such empty spaces, any discharge takes place from the conductive resin layer of the surface of the charging member to the surface of the electrophotographic photosensitive member, thus the phenomenon of discharge that is considered to usually take place only before and behind the nip takes place also inside the nip, as so considered. As the result, the charging member according to the present invention can bring out stable charging performance, as so considered.

Still further, the present inventors have also reached a finding that such a phenomenon of discharge inside the nip takes place because the inner walls of the bowl-shaped resin particles are covered (lined) with the conductive resin layer.

Figure 3:
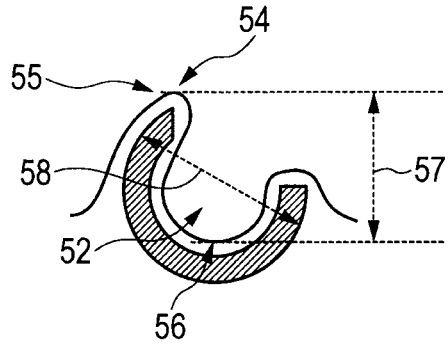
FIG. 3 is a partial sectional view showing a profile of the charging member according to the present invention in the vicinity of its surface.

As shown in FIG. 3, each top (or peak top) 55 of protrusions 54 derived from the edges of openings of the bowl-shaped resin particles and each bottom 56 of concavities 52 derived from the openings of the bowl-shaped resin particles may preferably be in a top-to-bottom distance 57 of from 5 μm or more to 100 μm or less, and particularly preferably from 8 μm or more to 80 μm or less. Inasmuch as the top-to-bottom distance is set within this range, the pressure of contact of the charging member with the electrophotographic photosensitive member can more surely be lessened, and the empty spaces inside the nip between them can be retained. Also, the ratio of maximum diameter 58 in each particle of the bowl-shaped resin particles to the top-to-bottom distance 57 between the top 55 of each protrusion and the bottom 56 of each concavity, i.e., the value of (maximum diameter)/(top-to-bottom distance) may preferably be from 0.8 or more to 3.0 or less. Inasmuch as the ratio is set within this range, the aforesaid pressure of contact can more surely be lessened, and the empty spaces inside the nip can be retained.

Upon formation of an uneven-surface profile that comes from the above bowl-shaped resin particles, it is preferable for the surface condition of the conductive resin layer to have been so controlled as to be the following. The conductive resin layer may preferably have a ten-point average surface roughness (Rzjis) of from 5 μm or more to 65 μm or less, and particularly preferably from 10 μm or more to 50 μm or less. Its surface may also preferably have a hill-to-dale average distance (Sm) of from 30 μm or more to 200 μm or less, and particularly preferably from 40 μm or more to 150 μm or less. Inasmuch as the Rzjis and Sm are set within these ranges, the aforesaid pressure of contact can more surely be lessened. The empty spaces inside the nip can also be retained. How to measure the ten-point average surface roughness (Rzjis) and hill-to-dale average distance (Sm) is detailed later.

Figure 4A:
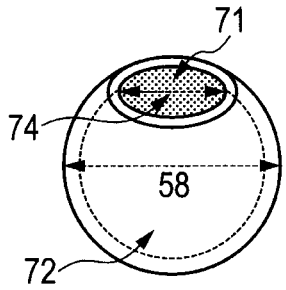
FIG. 4A is an illustration showing an example of the shape of the bowl-shaped resin particles used in the present invention.
Figure 4B:
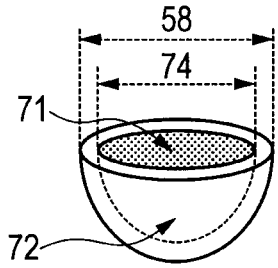
FIG. 4B is an illustration showing another example of the shape of the bowl-shaped resin particles used in the present invention.
Figure 4C:
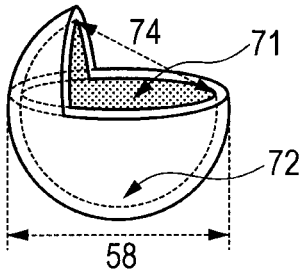
FIG. 4C is an illustration showing still another example of the shape of the bowl-shaped resin particles used in the present invention.
Figure 4D:
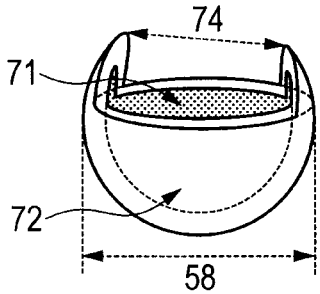
FIG. 4D is an illustration showing a further example of the shape of the bowl-shaped resin particles used in the present invention.
Figure 4E:
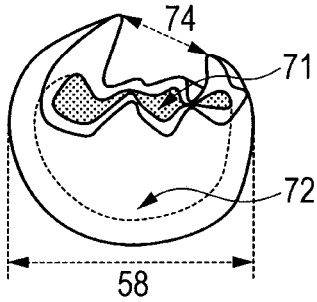
FIG. 4E is an illustration showing a still further example of the shape of the bowl-shaped resin particles used in the present invention.

Examples of the bowl-shaped resin particles used in the present invention are shown in FIGS. 4A to 4E. That is, "bowl-shaped" in the present invention refers to the shape that the particles have openings 71 and have roundish concavities 72 at the openings. The openings may have, as shown in FIGS. 4A and 4B, flat edges, or, as shown in FIGS. 4C to 4D, uneven edges. The bowl-shaped resin particles may preferably have, in each particle thereof, a maximum diameter of from 5 μm or more to 150 μm or less, and particularly preferably from 8 μm or more to 120 μm or less. Inasmuch as the maximum diameter is within this range, the discharge inside the nip can more surely be made to takes place.

The ratio of the maximum diameter 58 in each particle of the bowl-shaped resin particles to minimum diameter 74 in each of the openings, i.e., the value of (maximum diameter)/(opening minimum diameter) in each particle of the bowl-shaped resin particles may preferably be from 1.1 or more to 4.0 or less. Inasmuch as the ratio is so set, the aforesaid pressure of contact can more surely be lessened, and the empty spaces inside the nip can be retained.

Peripheral edges of the openings of the bowl-shaped resin particles may each preferably have a difference between outer diameter and inner diameter, of from 0.1 μm or more to 3 μm or less, and particularly preferably from 0.2 μm or more to 2 μm or less. Inasmuch as the difference is within this range, the aforesaid pressure of contact can more surely be lessened. Also, it is further preferable that such a difference between outer diameter and inner diameter is formed over the whole particles and substantially uniformly. What is meant by "substantially uniform" is that the difference is in the range of within ±50% of average value.

Binder:

As the binder, any known rubber or resin may be used. As the rubber, it may include, e.g., natural rubbers or those which have been subjected to vulcanization treatment, and synthetic rubbers. The synthetic rubbers may include the following: Ethylene-propylene rubber, styrene-butadiene rubber (SBR), silicone rubbers, urethane rubbers, isoprene rubber (IR), butyl rubber, acrylonitrile-butadiene rubber (NBR), chloroprene rubber (CR), acrylic rubbers, epichlorohydrin rubber and fluorine rubbers. As the resin, any of resins such as thermosetting resins and thermoplastic resins may be used, for example. In particular, preferred are fluorine resins, polyamide resins, acrylic resins, polyurethane resins, silicone resins and butyral resins. Any of these may be used alone, or may be used in the form of a mixture of two or more types. Also, monomers which are raw materials for the binder may be copolymerized to make a copolymer.

Where the conductive resin layer is formed of the first conductive resin layer and the second conductive resin layer, it is preferable to use the rubber as the binder used for the first conductive resin layer. This is because the pressure to be applied to the bowl-shaped resin particles shows a tendency to be more readily lessened. In the case when the rubber is used as the binder used for the first conductive resin layer, it is preferable to use the resin as the binder used for the second conductive resin layer. This is because its close contact and rubbing with the electrophotographic photosensitive member can more easily be controlled. The conductive resin layer may be formed by curing or cross-linking a mixture obtained by adding a cross-linking agent to raw materials of a binder made into a prepolymer. In the present invention, such a mixture is hereinafter also termed as the binder to provide a description.

Conductive Fine Particles:

The conductive resin layer contains known conductive fine particles in order to bring out its electrical conductivity. As specific examples of the conductive fine particles, they may include fine metal oxide particles, fine metal particles and carbon black. Any of these conductive fine particles may be used alone or in combination of two or more types. The conductive fine particles in the conductive resin layer may be in a content of approximately from 2 parts by mass to 200 parts by mass, and particularly from 5 parts by mass to 100 parts by mass, based on 100 parts by mass of the binder. The binder and conductive fine particles used in the first conductive resin layer and second conductive resin layer may be the same or may be different. The conductive resin layer contains the bowl-shaped resin particles standing unexposed to the surface, and hence it is preferable for the first conductive resin layer and second conductive resin layer to have adherence to and affinity for each other.

How to Form Conductive Resin Layer:

How to form the conductive resin layer is described below.

—Method 1—

In Method 1, first, a cover layer in which conductive fine particles and hollow resin particles have been dispersed in the binder (hereinafter also "preliminary cover layer") is formed on the conductive substrate. Then, its surface is sanded so as to cut away part of the hollow resin particles to make them bowl-shaped. Thus, the concavities derived from the openings of the bowl-shaped resin particles and the protrusions derived from the edges of the openings of the bowl-shaped resin particles are formed on the surface (hereinafter also "uneven-surface profile coming from the openings of the bowl-shaped resin particles"). The preliminary cover layer is sanded in this way to first form the first conductive resin layer. Further, on its surface, the second conductive resin layer is formed. This enables the bowl-shaped resin particles to stand unexposed to the surface.

Dispersion of Resin Particles in Preliminary Cover Layer:

How to disperse the hollow resin particles in the preliminary cover layer is described first.

As one method, a method is available in which a coating of a conductive resin composition in which hollow particles having a gas in their interiors stand dispersed together with the binder and the conductive fine particles is formed on the conductive substrate and then the coating formed is, e.g., dried, cured or cross-linked. As a material used for the hollow resin particles, it may include the known resins described previously.

As another method, a method may be exemplified which makes use of what is called thermally expandable microcapsules the particles of which contain in their interiors an encapsulated substance, where heat is applied to make the encapsulated substance expand to come into the hollow resin particles. It is a method in which a conductive resin composition is prepared in which the thermally expandable microcapsules stand dispersed together with the binder and the conductive fine particles, and a layer of this composition is formed on the conductive substrate and then, e.g., dried, cured or cross-linked. In the case of this method, the encapsulated substance may be made to expand by the heat supplied when the binder used in the preliminary cover layer is dried, cured or cross-linked, to form the hollow resin particles. In this course, their particle diameter and so forth may also be controlled by controlling temperature conditions and so forth.

In the case when the thermally expandable microcapsules are used, it is necessary to use a thermoplastic resin as the binder. Examples of the thermoplastic resin are given below: Acrylonitrile resin, vinyl chloride resin, vinylidene chloride resin, methacrylic acid resin, styrene resins, urethane resins, amide resins, methacrylonitrile resin, acrylic acid resin, acrylate resins, methacrylate resins and so forth. Of these, it is preferable to use a thermoplastic resin composed of at least one selected from acrylonitrile resin, vinylidene chloride resin and methacrylonitrile resin, as having a low gas permeability and exhibiting a high impact resilience. Any of these thermoplastic resins may be used alone or in combination of two or more types. Further, monomers for any of these thermoplastic resins may be copolymerized so as to be used as a copolymer.

As the substance to be entrapped in the thermally expandable microcapsules, one capable of vaporizing at a temperature not higher than the softening point of the thermoplastic resin used as the binder is preferred, and may include, e.g., the following: Low-boiling liquids such as propane, propylene, butane, normal butane, isobutane, normal pentane and isopentane; and high-boiling liquids such as normal hexane, isohexane, normal heptane, normal octane, isooctane, normal decane and isodecane.

The thermally expandable microcapsules may be produced by any known production process such as a suspension polymerization process, an interfacial polymerization process, an interfacial precipitation process or a solvent evaporation process. For example, in the suspension polymerization process, a method may be exemplified in which a polymerizable monomer(s), the substance to be entrapped in thermally expandable microcapsules and a polymerization initiator are mixed, the mixture obtained is dispersed in an aqueous medium containing a surface-active agent or a dispersion stabilizer and thereafter suspension polymerization is carried out. Here, a compound having a reactive group capable of reacting with functional groups of the polymerizable monomer, an organic filler and so froth may also be added.

As the polymerizable monomer, it may be exemplified by the following: Acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylates (such as methyl acrylate, ethyl acrylate, n-butyl acrylate, isobutyl acrylate, t-butyl acrylate, isobornyl acrylate, cyclohexyl acrylate and benzyl acrylate), methacrylates (such as methyl methacrylate, ethyl methacrylate, n-butyl methacrylate, isobutyl methacrylate, t-butyl methacrylate, isobornyl methacrylate, cyclohexyl methacrylate and benzyl methacrylate), styrene monomers, acrylamide, substituted acrylamide, methacrylamide, substituted methacrylamide, butadiene, ϵ-caprolactam, polyether and isocyanate. Any of these polymerizable monomers may be used alone or in combination of two or more types.

As the polymerization initiator, any of known peroxide initiators and azo initiators may be used. Of these, azo initiators are preferred. Specific examples of the azo initiators are given below: 2,2'-Azobisisobutyronitrile, 1,1'-azobiscyclohexane-1-carbonitrile, 2,2'-azobis(4-methoxy-2,4-dimethyl) valeronitrile and 2,2'-azobis(2,4-dimethyl)valeronitrile. In particular, 2,2'-azobisisobutyronitrile is preferred. Where the polymerization initiator is used, it may preferably be in an amount of from 0.01 part by mass to 5 parts by mass based on 100 parts by mass of the polymerizable monomer.

As the surface-active agent, any of anionic surface-active agents, cationic surface-active agents, nonionic surface-active agents, amphoteric surface-active agents and high-molecular type dispersants may be used. Where the surface-active agent is used, it may preferably be in an amount of from 0.01 part by mass to 10 parts by mass based on 100 parts by mass of the polymerizable monomer. As the dispersion stabilizer, it may include organic fine particles (such as fine polystyrene particles, fine polymethyl methacrylate particles, fine polyacrylic acid particles and fine polyepoxide particles, silica (such as colloidal silica), calcium carbonate, calcium phosphate, aluminum hydroxide, barium carbonate and magnesium hydroxide. Where the dispersion stabilizer is used, it may preferably be in an amount of from 0.01 part by mass to 20 parts by mass based on 100 parts by mass of the polymerizable monomer.

The suspension polymerization may preferably be carried out in a closed system, using a pressure container. The suspension polymerization may also be carried out after materials have been brought to suspension by means of a dispersion machine or the like and then moved to the pressure container, or the materials may be brought to suspension in the pressure container. Polymerization temperature may preferably be from 50° C. to 120° C. The polymerization may be carried out under atmospheric pressure, but may preferably be carried out under application of pressure (under pressure produced by adding 0.1 MPa to 1 MPa to atmospheric pressure) in order not to make gaseous the substance to be entrapped in the thermally expandable microcapsules. After the polymerization has been completed, the product may be subjected to solid-liquid separation and washing or the like by centrifugation, filtration or the like. Where the solid-liquid separation and washing are carried out, the product obtained may thereafter be dried and pulverized at a temperature not higher than the softening temperature of the resin constituting the thermally expandable microcapsules. It may be dried and pulverized by known methods, where any of an air-stream drier, a following-wind air drier, Nauta mixer and the like may be used. It may also be dried and pulverized simultaneously by means of a pulverization drier or the like. The surface-active agent and the dispersion stabilizer may be removed by repeating washing, filtration and so forth after production.

Formation of Preliminary Cover Layer:

Subsequently, how to form the preliminary cover layer is described. As a method for forming the preliminary cover layer, it may include electrostatic spray coating, dip coating, roll coating, a method in which a sheet-shaped or tube-shaped layer formed in a stated layer thickness is bonded to or covered on the conductive substrate, and a method in which the material is cured and molded into a stated shape in a mold. Also, especially in the case when the binder is a rubber, the conductive substrate and an unvulcanized rubber composition may integrally be extruded by means of an extrusion equipment having a cross-head, to produce the cover layer on the substrate. The cross-head is an extruder die used in the state it is provided at the tip of a cylinder of an extruder, which is used in order to make up cover layers of electric wires or thin metal threads. Thereafter, the layer formed is, e.g., dried, cured or cross-linked and thereafter the surface of the resultant preliminary cover layer is sanded so as to cut away part of the hollow resin particles to make them bowl-shaped. As a method for such sanding, cylindrical sanding or tape sanding may be used. As a cylindrical sander, it may be exemplified by an NC cylindrical sander of a traverse system and an NC cylindrical sander of a plunge cutting system.

(a) Where Preliminary Cover Layer has Thickness Not More than 5 Times the Volume-Average Particle Diameter of Hollow Resin Particles:

Where the preliminary cover layer has thickness not more than 5 times the volume-average particle diameter of the hollow resin particles, protrusions derived from the hollow resin particles are usually formed on the surface of the preliminary cover layer. Accordingly, part of the protrusions derived from the hollow resin particles is cut away, whereby the preliminary cover layer can be formed which stands incorporated with the bowl-shaped resin particles having openings on the surface of the preliminary cover layer. Also, the bowl-shaped resin particles have elasticity, and hence the edges of the openings formed on the surface of the preliminary cover layer can be made into shapes of protrusions by elastic deformation acting when the protrusions derived from the hollow resin particles are cut away.

In order to cut away the protrusions derived from the hollow resin particles, it is preferable to use the tape sanding. This is because the pressure applied to the charging member at the time of sanding is relatively small. As an example, a specific example of a sanding tape and sanding conditions are described below which are used when part of the protrusions of the preliminary cover layer is cut away by using a tape sanding method.

The sanding tape is obtained by coating a sheet-like base material with a coating liquid prepared by dispersing sanding abrasive grains in a resin. The sanding abrasive grains may be exemplified by particles of aluminum oxide, chromium oxide, silicon carbide, iron oxide, diamond, cerium oxide, corundum, silicon nitride, silicon carbide, molybdenum carbide, tungsten carbide, titanium carbide and silicon oxide. The sanding abrasive grains may preferably have an average particle diameter of from 0.01 μm or more to 50 μm or less, and much preferably from 1 μm or more to 30 μm or less. Here, the average particle diameter of the sanding abrasive grains is the median diameter D50 as measured by centrifugal sedimentation. The sanding tape having the sanding abrasive grains within the desired range may be of grain count which may preferably be in the range of from 500 or more to 20,000 or less, and much preferably from 1,000 or more to 10,000 or less. Examples of the sanding tape are given below: MAXIMA LAP, MAXIMA T Type (trade name; available from Ref-Lite Co., Ltd.); LAPIKA (trade name; available from Kovax Co., Ltd.); a lapping film MICROFINISHING FILM (trade name; available from Sumitomo 3M Limited.); a lapping film MIRROR FILM (trade name; available from Sankyo Rikagaku Co., Ltd.); and MIPOX, available from Nippon Microcoating K.K.).

The sanding tape may preferably be fed at a rate of from 10 mm/min or more to 500 mm/min or less, and particularly preferably from 50 mm/min or more to 300 mm/min or less. The sanding tape may preferably be pressed against the preliminary cover layer at a pressure of from 0.01 MPa or more to 0.4 MPa or less, and particularly preferably from 0.1 MPa or more to 0.3 MPa or less. In order to control the pressure at which the former is pressed against the latter, a back-up roller may be brought into touch with the preliminary cover layer through the sanding tape. Also, in order to obtain the desired shape, the sanding processing may be carried out over a plurality of times. Where a member on which the preliminary cover layer has been formed has a shape of being rotatable (e.g., in the case of the shape of a roller), it may preferably be set at a number of revolutions of from 10 rpm or more to 1,000 rpm or less, and particularly preferably from 50 rpm or more to 800 rpm or less.

Setting conditions as above enables the uneven-surface profile coming from the openings of the bowl-shaped resin particles, to be more readily formed on the surface of the first conductive resin layer. Incidentally, even though the preliminary cover layer has thickness within the above range, the concavities derived from the openings of the bowl-shaped resin particles and the protrusions derived from the edges of the openings of the same can also be formed by using a method (b) described below (b) Where Preliminary Cover Layer has Thickness More than 5 Times the Volume-Average Particle Diameter of Hollow Resin Particles:

Where the preliminary cover layer has thickness more than 5 times the volume-average particle diameter of the hollow resin particles, it may come about that the protrusions derived from the hollow resin particles are not formed on the surface of the preliminary cover layer. In such a case, the difference in sandability (capability of being sanded) between the hollow resin particles and the preliminary cover layer may be utilized to form the uneven-surface profile coming from the openings of the bowl-shaped resin particles.

The hollow resin particles entrap a gas in their interiors, and hence have a high impact resilience. In contrast thereto, as the binder of the preliminary cover layer, a rubber or resin is selected which has a relatively low impact resilience and also has a small elongation. This enables achievement of a state in which the preliminary cover layer can easily be sanded and the hollow resin particles can not easily be sanded. The preliminary cover layer kept in this state is sanded, whereupon only part of the hollow resin particles can be cut away to make them into the bowl-shaped resin particles. As the result, the openings of the bowl-shaped resin particles can be formed on the surface of the preliminary cover layer. This method is a method in which the difference in sandability between the hollow resin particles and the preliminary cover layer is utilized to form the concavities derived from the openings and the protrusions derived from the edges of the openings, and hence it is preferable to use a rubber as the binder used in the preliminary cover layer. Stated specifically, acrylonitrile butadiene rubber, styrene butadiene rubber or butadiene rubber may preferably be used, which has a low impact resilience and also has a small elongation.

As the hollow resin particles, those containing a resin having a polar group are preferable from the viewpoint that shells can have a low gas permeability and have a high impact resilience. Such a resin may include a resin having a unit represented by the following formula (1). Further, from the viewpoint of readiness to control the sandability, it is much preferable for the resin to have both the unit represented by the formula (1) and a unit represented by the following formula (5).

Formula (1)

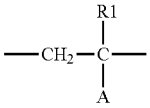

wherein A is at least one selected from the following formulas (2) to (4); and R1 is a hydrogen atom or an alkyl group having 1 to 4 carbon atom(s).

Formula (2)

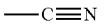

Formula (3)

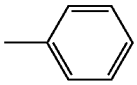

Formula (4)

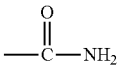

Formula (5)

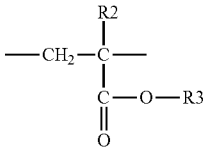

wherein R2 is a hydrogen atom or an alkyl group having 1 to 4 carbon atom(s); R3 is a hydrogen atom or an alkyl group having 1 to 10 carbon atom(s); and R2 and R3 may have the same structures or different structures.

Sanding Method:

As a method for sanding, cylindrical sanding or tape sanding may be used, but preferably on condition that the surface is more speedily sanded because it is necessary to remarkably bring out the difference in sandability between the materials. From this viewpoint, it is much preferable to use the cylindrical sanding. Of the cylindrical sanding, it is further preferable to use a plunge cutting system, from the viewpoint that the surface can simultaneously be sanded in its lengthwise direction and sanding time can be shortened. It is also preferable that the step of spark-out (the step of sanding at a penetration rate of 0 mm/min) carried out conventionally from the viewpoint of giving uniform sanded surface is set as possible as short in time, or not carried out at all.

As an example, ranges that are preferable as conditions for sanding the preliminary cover layer when a cylindrical sander of the plunge cutting system is used are shown below. The number of revolutions of a cylindrical sand grinding wheel may preferably be from 1,000 rpm or more to 4,000 rpm or less, and particularly preferably from 2,000 rpm or more to 4,000 rpm. The rate of penetration into the preliminary cover layer may preferably be from 5 mm/min or more to 30 mm/min or less, and particularly preferably from 10 mm/min or more. At the end of such a penetration step, the step of leveling the sanded surface may be provided, which may preferably be done at a penetration rate of from 0.1 mm/min or more to 0.2 mm/min or less within 2 seconds. The step of spark-out (the step of sanding at a penetration rate of 0 mm/min) may preferably be done for 3 seconds or less. The member on which the preliminary cover layer has been formed has a shape of being rotatable (e.g., in the case of the shape of a roller), it may preferably be set at a number of revolutions of from 50 rpm or more to 500 rpm or less, and particularly preferably from 200 rpm or more to 500 rpm. Setting the conditions as above enables the uneven-surface profile coming from the openings of the bowl-shaped resin particles, to be more readily formed on the surface of the first conductive resin layer.

Formation of Second Conductive Resin Layer:

Next, the first conductive resin layer is covered on the surface thereof with a conductive resin composition, followed by drying, curing, cross-linking or the like to form the second conductive resin layer. As a covering method, the method described previously may be used. It is necessary to provide the surface that has reflected the uneven-surface profile coming from the openings, and edges thereof, of the bowl-shaped resin particles. Hence, it is preferable for the second conductive resin layer to be relatively thin. The second conductive resin layer may have a thickness of approximately 50 μm or less, and particularly 30 μm or less. Accordingly, of the above covering method, a method is much preferable in which the second conductive resin layer is formed by electrostatic spray coating, dip coating, roll coating or the like. Where such a coating method is used, a coating liquid is prepared in which the conductive fine particles stand dispersed in the binder, which is used for the coating.

—Method 2—

The conductive fine particles and the bowl-shaped resin particles are dispersed in the binder to prepare a conductive resin composition. The conductive substrate is covered thereon with the composition obtained, followed by drying, curing, cross-linking or the like to form the conductive resin layer.

Bowl-Shaped Resin Particles:

The bowl-shaped resin particles may be produced by cutting away part of the hollow resin particles described previously. Instead, a polymerizable monomer may be so polymerized as for resin particles to become bowl-shaped in the course of their production. As a method for so producing the resin particles as to become bowl-shaped, a method is available in which the polymerizable monomer is subjected to suspension polymerization in the presence of a cross-linking agent, a hydrophobic liquid and a polymerization initiator and with stirring in water to prepare particles which entrap the hydrophobic liquid in their polymer films of a polymer. In this method, hydrophobic substance is entrapped in the interiors of the particles of the polymer formed during polymerization, and the polymer deforms during the polymerization to come into bowl-shaped resin particles.

The polymerization initiator may include the following: Styrene, methylstyrene, vinyl toluene, methacrylates, acrylates, vinyl acetate, acrylonitrile, vinyl chloride, vinylidene chloride, chloroprene, isoprene, butadiene, acrolein, acrylamide, allyl alcohol, vinyl pyridine, vinyl benzoate, allyl benzoate, and mixtures of any of these.

The cross-linking agent may be exemplified by divinylbenzene, ethylene dimethacrylate, triethylene glycol dimethacrylate, 1,3-butylene dimethacrylate, allyl methacrylate, and trimethylol propane trimethacrylate. Two or more types of these may be used in combination. The cross-linking agent may be in an amount of from 0.1% by mass to 30% by mass, and particularly from 1% by mass to 20% by mass, based on 100% by mass of the polymerizable monomer. Inasmuch as the amount of the cross-linking agent is set within this range, the particles can appropriately be deformed.

The hydrophobic liquid may be exemplified by hydrocarbon oils, animal oils, vegetable oils, esters, ethers and silicones. The hydrophobic liquid may be in an amount of from 15% by mass or more to 100% by mass or less, based on 100% by mass of the polymerizable monomer. Inasmuch as the amount of the hydrophobic liquid is set within this range, the resin particles can readily become bowl-shaped.

As the polymerization initiator, a radical catalyst may preferably be used, as exemplified by benzoyl peroxide, methyl ethyl ketone peroxide, t-butyl peroxide, 2,2'-azobisisobutyronitrile and 2,2'-azobis(2,4-dimethyl)valeronitrile.

To the water, a suspension stabilizer may be added, as exemplified by polyvinyl alcohol, gelatin, methyl cellulose, sodium alginate, calcium phosphate, colloidal silica, bentonite and aluminum oxide. An anti-coagulant such as titanium oxide or calcium carbonate may also be added thereto so as for the particles not to coagulate at the time of drying. Polymerization temperature may commonly preferably be from 50° C. to 95° C. The particle diameter of fine particles is influenced by the rate of stirring, and hence the stirring may preferably be carried out at from 50 rpm to 500 rpm, and particularly preferably from 100 rpm to 300 rpm. Polymerization time may preferably be from 3 hours to 24 hours. The particles formed may preferably be dried after they have been taken out of the water, and the drying may preferably be carried out at a temperature lower than the softening temperature of the polymer, i.e., at from 30° C. to 90° C.

Formation of Conductive Resin Layer:

The bowl-shaped resin particles are mixed together with the binder and the conductive fine particles to prepare a conductive resin composition. The conductive substrate is covered thereon with this conductive resin composition to form the conductive resin layer. As a method for covering, the method described previously may be used. Here, in order to form the concavities derived from the openings of the bowl-shaped resin particles and form the protrusions derived from the edges of the openings of the same, the conductive resin layer may preferably have a layer thickness that is not more than 5 times, and particularly preferably not more than 3 times, the maximum diameter of the bowl-shaped resin particles.

In order to form such a profile, it is preferable to use a process having the steps of preparing a conductive resin coating liquid in which the conductive fine particles and the bowl-shaped resin particles stand mixed, and coating it by electrostatic spray coating, dip coating, roll coating or the like, followed by drying or heating. In this case, in the step of drying the coating formed, it is preferable to dry the coating at a higher temperature or to form the coating in a lower internal solid-matter concentration. In such a drying step, any volatile component from the coating can volatilize at a higher rate, and the flow of the volatile component volatilizing at a higher rate enables the openings of the bowl-shaped resin particles to face toward the surface side of the conductive resin layer to form the uneven-surface profile. In order to control the rate of volatilization, it is preferable to use in the coating liquid the solvent described previously.

A specific example in this method is shown below. First, dispersive components other than the bowl-shaped resin particles, e.g., the conductive fine particles are mixed in the binder together with glass beads of 0.8 mm in diameter, and dispersed therein over a period of from 12 hours to 36 hours by means of a paint shaker dispersion machine. Then, the bowl-shaped resin particles are added thereto and dispersed therein. As dispersion time, it may preferably be from 2 minutes or more to 30 minutes or less. Here, it is necessary to set such conditions that the bowl-shaped resin particles are by no means pulverized. Thereafter, the dispersion formed is so controlled as to have a viscosity of from 3 mPa to 30 mPa, and particularly preferably from 3 mPa to 20 mPa to obtain a coating liquid. Next, the conductive substrate is coated thereon with this coating liquid by dipping or the like to form such a coating thereof that may provide a dried-layer thickness of from 1 μm to 50 μm, and particularly preferably from 5 μm to 30 μm. This coating is dried at a temperature of from 20° C. to 50° C., and particularly at a temperature of from 30° C. to 50° C. Thereafter, treatment such as curing or cross-linking may be carried out.

Here, as a method for dispersing the conductive fine particles and so forth in the binder, the dispersion means described previously may be used. The layer thickness may be measured by the method described previously. The above bowl-shaped resin particles in the conductive resin layer may preferably be in a content of from 2 parts by mass or more to 120 parts by mass or less, and particularly preferably from 5 parts by mass or more to 100 parts by mass or less, based on 100 parts by mass of the binder. Setting their content within this range enables easier formation of the uneven-surface profile coming from the openings of the bowl-shaped resin particles.

Other Components in Conductive Resin Layer:

The conductive resin layer in the present invention may contain, in addition to the conductive fine particles described previously, an ionic conducting agent and insulating particles. The conductive resin layer may preferably have a volume resistivity of approximately from $1\times10^{2}$ Ω·cm or more to $1\times10^{16}$ Ω·cm or less in an environment of temperature 23° C./humidity 50% RH. Setting its volume resistivity within this range makes it easier for the electrophotographic photosensitive member to be appropriately charged by discharging.

The volume resistivity of the conductive resin layer is determined in the following way. First, from the charging member, the conductive resin layer is cut out in the shape of an oblong card of about 5 mm in length, about 5 mm in width and about 1 mm in thickness. A metal is vacuum-deposited on its both sides to make an electrode and a guard electrode to obtain a sample for measurement. Where the conductive resin layer is too thin to be cut out, an aluminum sheet is coated thereon with a conductive resin composition for forming the conductive resin layer to form a coating film, and the metal is vacuum-deposited on the coating film surface to obtain a sample for measurement. To the sample for measurement thus obtained, a voltage of 200 V is applied by using a micro-current meter (trade name: ADVANTEST R8340A Ultra-high Resistance Meter; manufactured by Advantest Co., Ltd.). Then, electric current after 30 seconds is measured, and calculation is made from layer thickness and electrode area to find the volume resistivity. The volume resistivity of the conductive resin layer may be controlled by using the conductive fine particles and ionic conducting agent described previously. Also, the conductive fine particles may have an average particle diameter of approximately from 0.01 μm to 0.9 μm, and particularly from 0.01 μm to 0.5 μm. The conductive fine particles in the conductive resin layer may be in a content of approximately from 2 parts by mass to 80 parts by mass, and particularly from 20 parts by mass to 60 parts by mass based on 100 parts by mass of the binder.

Conductive Substrate:

The conductive substrate used in the charging member of the present invention is one having electrical conductivity and having the function to support the conductive resin layer and so forth provided thereon. As a material therefor, it may include, e.g., metals such as iron, copper, stainless steel, aluminum and nickel, and alloys of any of these.

Conductive Elastic Layer:

In the charging member of the present invention, a conductive elastic layer may be formed between the conductive substrate and the conductive resin layer. As a binder used to form the conductive elastic layer, any known rubber or resin may be used. From the viewpoint of securing a sufficient nip between the charging member and the electrophotographic photosensitive member, it is preferable for the layer to have a relatively low elasticity, and is much preferable to use a rubber. As the rubber, it may be exemplified by the rubber described previously. The conductive elastic layer may preferably have a volume resistivity of from $10^{2}$ Ω·cm or more to $10^{10}$ Ω·cm or less in an environment of temperature 23° C./humidity 50% RH.

The volume resistivity of the conductive elastic layer may be controlled by appropriately adding to the binder a conducting agent such as carbon black, a conductive metal oxide, an alkali metal salt or an ammonium salt. Where the binder is a polar rubber, it is particularly preferable to use an ammonium salt. The conductive elastic layer may also be incorporated with additives such as a softening oil and a plasticizer and the above insulating particles, in addition to the conductive fine particles and in order to control hardness and so forth. The conductive elastic layer may also be provided by bonding it with an adhesive, between the conductive substrate and the conductive resin layer. As the adhesive, it is preferable to use a conductive adhesive.

Charging Member

The charging member according to the present invention may at least have the conductive substrate and conductive resin layer described above, and may also have any shape such as a roller-shaped one or a flat-plate-shaped one. In the following, as an example of the charging member, a charging roller is used to describe it in detail. Onto the conductive substrate, the layer lying directly thereon (the conductive elastic layer) may be bonded with an adhesive. In this case, the adhesive may preferably be electrically conductive. In order to make the adhesive electrically conductive, it may have a known conducting agent. As a binder of the adhesive, it may include thermosetting resins and thermoplastic resins, and any known resins may be used which are of a urethane type, an acrylic type, a polyester type, a polyether type or an epoxy type.

As the conducting agent for providing the adhesive with electrical conductivity, it may be selected from the conductive fine particles and ionic conducting agent described previously, any of which may be used alone or in combination of two or more types.

In order to make the electrophotographic photosensitive member well chargeable electrostatically, the charging member of the present invention may usually much preferably have an electrical resistance value of from $1\times10^{3}\Omega$ or more to $1\times10^{10}\Omega$ or less in an environment of temperature 23° C./humidity 50% RH.

From the viewpoint of making lengthwise nip width uniform to the electrophotographic photosensitive member, the charging roller of the present invention may preferably be in a crown shape in which the roller is thickest at the middle in its lengthwise direction and is thinner as it comes to the both ends in its lengthwise direction. As a crown level, the difference in external diameter between that at the middle portion and that at positions 90 mm away from the middle portion may preferably be from 30 μm or more to 200 μm or less. The surface of the charging roller may preferably have a hardness of 90° or less, and much preferably from 40° or more to 80° or less, as microhardness (MD-1 Model). Setting its hardness within this range makes it easy to stabilize its contact with the electrophotographic photosensitive member, and enables stable in-nip discharge.

Electrophotographic Apparatus

Figure 6:
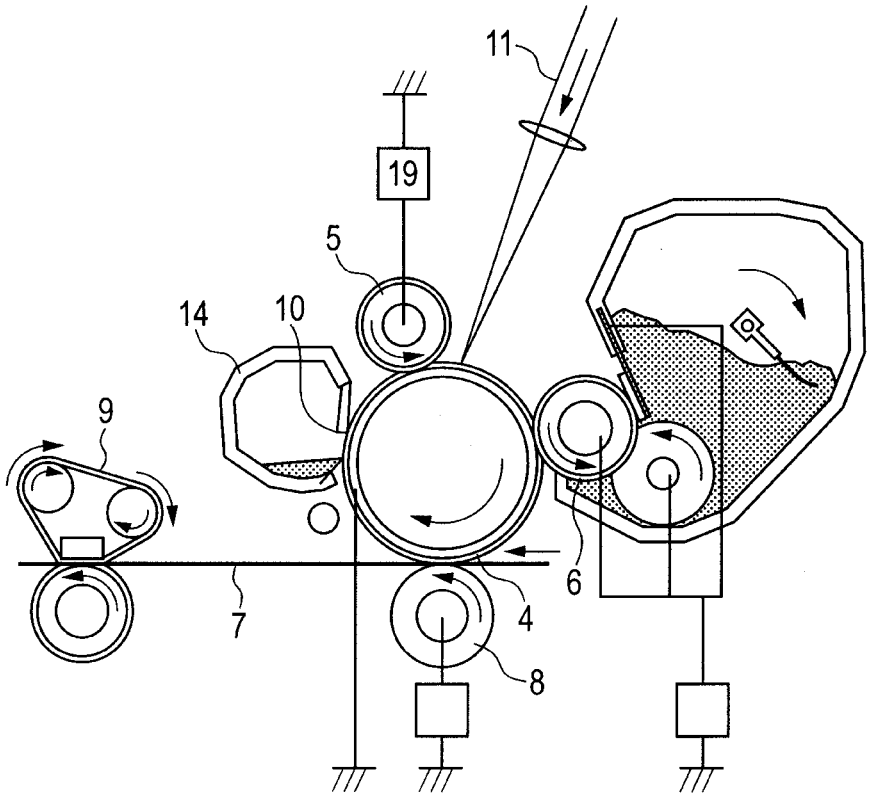
FIG. 6 is a schematic sectional view of an embodiment of the electrophotographic apparatus according to the present invention.

The charging member of the present invention may be used as a component part of an electrophotographic apparatus. This electrophotographic apparatus has at least a charging member, an exposure unit and a developing assembly. The construction of an example of an electrophotographic apparatus having the charging member of the present invention is schematically shown in FIG. 6. The electrophotographic apparatus has an electrophotographic photosensitive member, a charging assembly for the electrophotographic photosensitive member, a latent image forming unit, a developing assembly, a transfer assembly, a cleaning unit which collects any transfer residual toner remaining on the electrophotographic photosensitive member, a fixing assembly and so froth.

An electrophotographic photosensitive member 4 is of a rotating drum type having a photosensitive layer on a conductive substrate, and is rotatingly driven at a stated peripheral speed (process speed) in the direction shown by an arrow. The charging assembly has a charging roller 5 of a contact system which is provided in contact with the electrophotographic photosensitive member 4 at a stated pressing force. The charging roller 5 is follow-up rotated with the rotation of the electrophotographic photosensitive member 4, and a stated direct-current voltage is applied thereto from a charging power source 19 to charge the electrophotographic photosensitive member 4 electrostatically to a stated potential. As a latent image forming unit 11 which forms an electrostatic latent image on the electrophotographic photosensitive member 4, an exposure unit such as a laser beam scanner is used, for example. The electrophotographic photosensitive member 4 thus charged uniformly is exposed to light in accordance with image information to form the electrostatic latent image thereon.

The developing assembly has a developing sleeve or developing roller 6 which is provided in proximity to or in contact with the electrophotographic photosensitive member 4. The electrostatic latent image is developed by reverse development with a toner having electrostatically been processed to have the same polarity as charge polarity of the electrophotographic photosensitive member, to form a toner image thereon. The transfer assembly has a contact type transfer roller 8. The toner image is transferred from the electrophotographic photosensitive member to a transfer material 7 such as plain paper (the transfer material is transported by a paper feed system having a transport member). The cleaning unit has a blade type cleaning member 10 and a collecting container 14, and mechanically scrapes off and collects any transfer residual toner remaining on the electrophotographic photosensitive member after transfer. Here, a cleaning-at-development system which collects the transfer residual toner with the developing assembly may be employed so as to omit the cleaning unit. A fixing assembly 9 is constituted of a roll or the like to be kept heated, and fixes to the transfer material 7 the toner image having been transferred thereto, which is then delivered out of the machine.

Process Cartridge

The process cartridge according to the present invention is characterized by having the above charging member and a charging object member (an electrophotographic photosensitive member) provided in contact with the charging member which are integrally joined, and being so constituted as to be detachably mountable to the main body of the electrophotographic apparatus.

EXAMPLES

The present invention is described below in greater detail by giving specific working examples.

Production Examples

Production Examples 1 to 69 are given below. These production examples are itemized as follows: Production Examples 1 to 38, 44 and 55 are production examples for the hollow resin particles. Production Examples 39 to 43 are production examples for the bowl-shaped resin particles. Production Examples 46 to 49 are production examples for conductive rubber compositions containing the hollow resin particles.

Production Example 50 is a production example for composite conductive fine particles. Production Example 51 is a production example for surface-treated titanium oxide particles. Production Examples 52 to 59 are production examples for conductive resin coating liquids 1 to 8 not containing any hollow resin particles. Production Examples 60 to 68 are production examples for conductive resin coating liquids 9 to 17 containing the hollow resin particles. Production Example 69 is a production example for a conductive rubber composition. Average particle diameter of the resin particles refers to volume-average particle diameter.

Production Example 1

Making of Hollow Resin Particles 1:

To 4,000 parts by mass of ion-exchanged water, 9 parts by mass of colloidal silica and 0.15 part by mass of polyvinyl pyrrolidone as dispersion stabilizers were added to prepare a water-based mixture. Next, an oil-based mixture was prepared which was composed of 50 parts by mass of acrylonitrile, 45 parts by mass of methacrylonitrile and 5 parts by mass of methyl methacrylate as polymerizable monomers, 12.5 parts by mass of normal hexane as an encapsulated substance and 0.75 part by mass of dicumyl peroxide as a polymerization initiator. This oil-based mixture was added to the above water-based mixture, and further 0.4 part by mass of sodium hydroxide was added thereto to prepare a liquid dispersion.

The liquid dispersion obtained was stirred and mixed for 3 minutes by means of a homogenizer, which was then fed into a polymerization reaction vessel the interior of which had been displaced with nitrogen, to carry out reaction at 60° C. for 20 hours with stirring at 200 rpm to prepare a reaction product. The reaction product obtained was repeatedly filtered and washed with water, followed by drying at 80° C. for 5 hours to make hollow resin particles. The hollow resin particles obtained were disintegrated and classified by means of a sonic-wave classifier to obtain resin particles 1 having an average particle diameter of 12 μm.

Production Example 2

Making of Hollow Resin Particles 2:

Resin particles were made in the same way as those in Production Example 1 except that the colloidal silica was added in an amount changed to 4.5 parts by mass. The particles obtained were also classified in the same way to obtain resin particles 2 having an average particle diameter of 50 μm.

Production Example 3

Making of Hollow Resin Particles 3:

Particles having an average particle diameter of 60 μm which were only different in particle diameter from those classified in Production Example 2 were obtained as resin particles 3.

Production Example 4

Making of Hollow Resin Particles 4:

Particles having an average particle diameter of 18 μm which were only different in particle diameter from those classified in Production Example 1 were obtained as resin particles 4.

Production Example 5

Making of Hollow Resin Particles 5:

Particles having an average particle diameter of 10 μm which were only different in particle diameter from those classified in Production Example 1 were obtained as resin particles 5.

Production Example 6

Making of Hollow Resin Particles 6:

Particles having an average particle diameter of 40 μm which were only different in particle diameter from those classified in Production Example 2 were obtained as resin particles 6.

Production Example 7

Making of Hollow Resin Particles 7:

Particles having an average particle diameter of 15 μm which were only different in particle diameter from those classified in Production Example 1 were obtained as resin particles 7.

Production Example 8

Making of Hollow Resin Particles 8:

Resin particles were made in the same way as those in Production Example 2 except that the polymerizable monomers were changed for 80 parts by mass of acrylonitrile and 20 parts by mass of methyl methacrylate. The particles obtained were also classified in the same way to obtain resin particles 8 having an average particle diameter of 30 μm.

Production Example 9

Making of Hollow Resin Particles 9:

Resin particles were made in the same way as those in Production Example 8 except that the colloidal silica was added in an amount changed to 9 parts by mass. The particles obtained were also classified in the same way to obtain resin particles 9 having an average particle diameter of 10 μm.

Production Example 10

Making of Hollow Resin Particles 10:

Particles having an average particle diameter of 15 μm which were only different in particle diameter from those classified in Production Example 9 were obtained as resin particles 10.

Production Example 11

Making of Hollow Resin Particles 11:

Particles having an average particle diameter of 50 μm which were only different in particle diameter from those classified in Production Example 8 were obtained as resin particles 11.

Production Example 12

Making of Hollow Resin Particles 12:

Resin particles were made in the same way as those in Production Example 1 except that the polymerizable monomers were changed for 45 parts by mass of methacrylonitrile and parts by mass of methyl acrylate. The particles obtained were also classified in the same way to obtain resin particles 12 having an average particle diameter of 25 μm.

Production Example 13

Making of Hollow Resin Particles 13:

Particles having an average particle diameter of 15 μm which were only different in particle diameter from those classified in Production Example 12 were obtained as resin particles 13.

Production Example 14

Making of Hollow Resin Particles 14:

Resin particles were made in the same way as those in Production Example 12 except that the colloidal silica was added in an amount changed to 4.5 parts by mass. The particles obtained were also classified in the same way to obtain resin particles 14 having an average particle diameter of 30 μm.

Production Example 15

Making of Hollow Resin Particles 15:

Particles having an average particle diameter of 40 μm which were only different in particle diameter from those classified in Production Example 14 were obtained as resin particles 15.

Production Example 16

Making of Hollow Resin Particles 16:

Resin particles were made in the same way as those in Production Example 2 except that the polymerizable monomers were changed for 45 parts by mass of acrylamide and 55 parts by mass of methacrylamide. The particles obtained were also classified in the same way to obtain resin particles 16 having an average particle diameter of 40 μm.

Production Example 17

Making of Hollow Resin Particles 17:

Particles having an average particle diameter of 45 μm which were only different in particle diameter from those classified in Production Example 16 were obtained as resin particles 17.

Production Example 18

Making of Hollow Resin Particles 18:

Particles having an average particle diameter of 30 μm which were only different in particle diameter from those classified in Production Example 16 were obtained as resin particles 18.

Production Example 19

Making of Hollow Resin Particles 19:

Resin particles were made in the same way as those in Production Example 1 except that the polymerizable monomers were changed for 37.5 parts by mass of acrylonitrile and 62.5 parts by mass of methacrylamide. The particles obtained were also classified in the same way to obtain resin particles 19 having an average particle diameter of 8 μm.

Production Example 20

Making of Hollow Resin Particles 20:

Particles having an average particle diameter of 20 μm which were only different in particle diameter from those classified in Production Example 19 were obtained as resin particles 20.

Production Example 21

Making of Hollow Resin Particles 21:

Particles having an average particle diameter of 25 μm which were only different in particle diameter from those classified in Production Example 19 were obtained as resin particles 21.

Production Example 22

Making of Hollow Resin Particles 22:

Resin particles were made in the same way as those in Production Example 1 except that the polymerizable monomers were changed for 50 parts by mass of methacrylonitrile and 50 parts by mass of acrylamide. The particles obtained were also classified in the same way to obtain resin particles 22 having an average particle diameter of 20 μm.

Production Example 23

Making of Hollow Resin Particles 23:

Resin particles 23 having an average particle diameter of 30 μm were made in the same way as those in Production Example 22 except that the colloidal silica was added in an amount changed to 4.5 parts by mass.

Production Example 24

Making of Resin Particles 24:

Resin particles were made in the same way as those in Production Example 2 except that the polymerizable monomers were changed for 60 parts by mass of methyl methacrylate and 40 parts by mass of acrylamide. The particles obtained were also classified in the same way to obtain resin particles 24 having an average particle diameter of 40 μm.

Production Example 25

Making of Hollow Resin Particles 25:

Particles having an average particle diameter of 50 μm which were only different in particle diameter from those classified in Production Example 24 were obtained as resin particles 25.

Production Example 26

Making of Hollow Resin Particles 26:

Resin particles were made in the same way as those in Production Example 24 except that the colloidal silica was added in an amount changed to 18 parts by mass. The particles obtained were also classified in the same way to obtain resin particles 26 having an average particle diameter of 10 μm.

Production Example 27

Making of Hollow Resin Particles 27:

Resin particles were made in the same way as those in Production Example 1 except that the polymerizable monomers were changed for 100 parts by mass of acrylamide. The particles obtained were also classified in the same way to obtain resin particles 27 having an average particle diameter of 8 μm.

Production Example 28

Making of Hollow Resin Particles 28:

Particles having an average particle diameter of 20 μm which were only different in particle diameter from those classified in Production Example 27 were obtained as resin particles 28.

Production Example 29

Making of Hollow Resin Particles 29:

Particles having an average particle diameter of 25 μm which were only different in particle diameter from those classified in Production Example 27 were obtained as resin particles 29.

Production Example 30

Making of Hollow Resin Particles 30:
Resin particles were made in the same way as those in Production Example 1 except that the polymerizable monomers were changed for 100 parts by mass of methacrylamide. The particles obtained were also classified in the same way to obtain resin particles 30 having an average particle diameter of 20 μm.

Production Example 31

Making of Hollow Resin Particles 31:
Particles having an average particle diameter of 25 μm which were only different in particle diameter from those classified in Production Example 30 were obtained as resin particles 31.

Production Example 32

Making of Hollow Resin Particles 32:
Resin particles were made in the same way as those in Production Example 2 except that the polymerizable monomers were changed for 55 parts by mass of methyl methacrylate and 45 parts by mass of methacrylamide. The particles obtained were also classified in the same way to obtain resin particles 32 having an average particle diameter of 30 μm.

Production Example 33

Making of Hollow Resin Particles 33:
Particles having an average particle diameter of 45 μm which were only different in particle diameter from those classified in Production Example 32 were obtained as resin particles 33.

Production Example 34

Making of Hollow Resin Particles 34:
Resin particles were made in the same way as those in Production Example 1 except that the polymerizable monomers were changed for 100 parts by mass of styrene. The particles obtained were also classified in the same way to obtain resin particles 34 having an average particle diameter of 15 μm.

Production Example 35

Making of Hollow Resin Particles 35:
Particles having an average particle diameter of 10 μm which were only different in particle diameter from those classified in Production Example 34 were obtained as resin particles 35.

Production Example 36

Making of Hollow Resin Particles 36:
Resin particles were made in the same way as those in Production Example 34 except that the colloidal silica was added in an amount changed to 4.5 parts by mass. The particles obtained were also classified in the same way to obtain resin particles 36 having an average particle diameter of 40 μm.

Production Example 37

Making of Hollow Resin Particles 37:
Resin particles were made in the same way as those in Production Example 2 except that the polymerizable monomers were changed for 100 parts by mass of methyl methacrylate. The particles obtained were also classified in the same way to obtain resin particles 37 having an average particle diameter of 50 μm.

Production Example 38

Making of Hollow Resin Particles 38:
Particles having an average particle diameter of 40 μm which were only different in particle diameter from those classified in Production Example 37 were obtained as resin particles 38.

Production Example 39

Making of Bowl-Shaped Resin Particles 39:
To 250 parts by mass of ion-exchanged water, 12.5 parts by mass of colloidal silica (solid content: 20% by mass) and 0.8 part by mass of an adipic acid-diethanolamine condensation product (50% condensation product) were added to prepare a water-based mixture having a pH of 3.3. The pH was adjusted with sulfuric acid.

Next, an oil-based mixture was prepared which was composed of 90 parts by mass of methyl methacrylate and parts by mass of ethylene glycol dimethacrylate as polymerizable monomers, 25 parts by mass of liquid paraffin as an encapsulated substance and 0.8 part by mass of 2,2'-azobisbutyronitrile. This oil-based mixture was mixed with the above water-based mixture, and these were put to high-rate stirring for 3 minutes by means of T.K. Homomixer (manufactured by Tokushu Kika Kogyo Co., Ltd.). Thereafter, the mixture obtained was fed into a polymerization reaction vessel the interior of which had been displaced with nitrogen, to carry out reaction at 65° C. for 5 hours with stirring at 200 rpm. The reaction product obtained was repeatedly filtered and washed with water, followed by drying at 80° C. for 5 hours to make bowl-shaped resin particles. The bowl-shaped resin particles obtained were disintegrated and classified by means of a sonic-wave classifier to obtain resin particles 39 having an average particle diameter of 22 μm.

Production Example 40

Making of Bowl-Shaped Resin Particles 40:
Resin particles 40 having an average particle diameter of 5 μm were obtained in the same way as those in Production Example 39 except that the rate of stirring at the time of polymerization reaction was changed to 300 rpm.

Production Example 41

Making of Bowl-Shaped Resin Particles 41:
Particles having an average particle diameter of 17 μm which were only different in particle diameter from those classified in Production Example 39 were obtained as resin particles 41.

Production Example 42

Making of Bowl-Shaped Resin Particles 42:
Resin particles 42 having an average particle diameter of 11 μm were obtained in the same way as those in Production Example 39 except that the methyl methacrylate was used in an amount changed to 75 parts by mass, the ethylene glycol dimethacrylate 8.3 parts by mass, the liquid paraffin 42 parts by mass and the 2,2'-azobisbutyronitrile 0.5 part by mass.

Production Example 43

Making of Bowl-Shaped Resin Particles 43:
Resin particles 43 having an average particle diameter of 5 μm were obtained in the same way as those in Production Example 42 except that the rate of stirring at the time of polymerization reaction was changed to 200 rpm.

Production Example 44

Making of Hollow Resin Particles 44:
Resin particles 44 having an average particle diameter of 50 μm were made in the same way as those in Production Example 2 except that the polymerizable monomers were changed for 100 parts by mass of acrylonitrile.

Production Example 45

Making of Hollow Resin Particles 45:
Resin particles having an average particle diameter of 50 μm were made in the same way as those in Production Example 2 except that the polymerizable monomers were changed for 100 parts by mass of vinylidene chloride.

Production Example 46

Preparation of Conductive Rubber Composition 1 Making Use of Acrylonitrile-Butadiene Rubber:
To 100 parts by mass of acrylonitrile-butadiene rubber (NBR) (trade name: N230SV; available from JSR Corporation), the following four components were added, and these were kneaded for 15 minutes by means of a closed mixer temperature-controlled at 50° C.

Carbon black (trade name: TOKA BLACK #7360SB; available from Tokai Carbon Co., Ltd.): 48 parts by mass
Zinc stearate (trade name: SZ-2000; available from Sakai Chemical Industries Co., Ltd.): 1 part by mass
Zinc oxide (trade name: Zinc White Class 2; available from Sakai Chemical Industries Co., Ltd.): 5 parts by mass
Calcium carbonate (trade name: SILVER W; available from Shiraishi Kogyo Kaisha, Ltd.): 20 parts by mass To this kneaded product, 12 parts by mass of the resin particles 1, 1.2 parts by mass of sulfur as a vulcanizing agent and 4.5 parts by mass of tetrabenzylthiuram disulfide (TBzTD) (trade name: PERKACIT TBzTD; available from Flexis Co.) as a vulcanization accelerator were added. Then, these were kneaded for 10 minutes by means of a twin-roll mill kept cooled to a temperature of 25° C., to make up a conductive rubber composition 1.

Production Example 47

Preparation of Conductive Rubber Composition 2 Making Use of Styrene-Butadiene Rubber:
To 100 parts by mass of styrene-butadiene rubber (SBR) (trade name: SBR1500; available from JSR Corporation), the following six components were added, and these were kneaded for 15 minutes by means of a closed mixer temperature-controlled at 80° C.

Zinc oxide (the same as that in Production Example 46): 5 parts by mass
Zinc stearate (the same as that in Production Example 46): 2 parts by mass
Carbon black (trade name: KETJEN BLACK EC600JD; available from Lion Corporation): 8 parts by mass
Carbon black (trade name: SEAST; available from Tokai Carbon Co., Ltd.): 40 parts by mass
Calcium carbonate (the same as that in Production Example 46): 15 parts by mass
Paraffin oil (trade name: PW380; available from Idemitsu Kosan Co., Ltd.): 20 parts by mass To this kneaded product, the following materials were added, and these were kneaded for 10 minutes by means of a twin-roll mill kept cooled to a temperature of 25° C., to make up a conductive rubber composition 2.

Resin particles 6: 20 parts by mass
Sulfur as a vulcanizing agent: 1 part by mass
Dibenzothiazyl sulfide (DM) as vulcanization accelerator (trade name: NOCCELLER DM; available from Ohuchi-Shinko Chemical Industrial Co., Ltd.): 1 part by mass
Tetramethylthiuram monosulfide (TS) (trade name: NOCCELLER TS; available from Ohuchi-Shinko Chemical Industrial Co., Ltd.): 1 part by mass Production Example 48

Preparation of Conductive Rubber Composition 3 Making Use of Butadiene Rubber:
A conductive rubber composition 3 was prepared in the same way as that in Production Example 46 except that the acrylonitrile-butadiene rubber (NBR) was changed for butadiene rubber (BR) "JSR BRO1" (trade name; available from JSR Corporation), the carbon black was used in an amount changed to 30 parts by mass and 12 parts by mass of the resin particles 1 were changed for 8 parts by mass of the resin particles 31.

Production Example 49

Preparation of Conductive Rubber Composition 4 Making Use of Chloroprene Rubber:
To 75 parts by mass of chloroprene rubber (trade name: SHOPRENE; available from Showa Denko K.K.), the following three components were added, and these were kneaded for 15 minutes by means of a closed mixer temperature-controlled at 50° C.

NBR (trade name: NIPOL 401LL; available from Nippon Zeon Co., Ltd.): 25 parts by mass
Hydrotalcite (trade name: DHT-4A-2; available from Kyowa Chemical Industry Co., Ltd.): 3 parts by mass
Quaternary ammonium salt (trade name: KS-555; available from Kao Corporation): 5 parts by mass To this kneaded product, 3 parts by mass of the resin particles 27, 0.5 part by mass of sulfur as a vulcanizing agent and 1.4 parts by mass of ethylene thiourea (trade name: ACCEL 22-S; available from Kawaguchi Chemical Industry Co., Ltd.) as a vulcanization accelerator were added. Then, these were kneaded for 15 minutes by means of a twin-roll mill kept cooled to a temperature of 20° C., to make up a conductive rubber composition 4.

Production Example 50

Making of Composite Conductive Fine Particles:
To 7,000 parts by mass of silica particles (average particle diameter: 15 nm; volume resistivity: $1.8\times10^{12}$ Ω·cm), 140 parts by mass of methylhydrogenpolysiloxane was added operating an edge runner mill. Then, these materials were mixed and agitated for 30 minutes at a linear load of 588 N/cm (60 kg/cm). Here, the agitation was carried out at a rate of 22 rpm. To what was thus agitated, 7,000 parts by mass of carbon black "#52" (trade name; available from Mitsubishi Chemical Corporation) were added over a period of 10 minutes, operating the edge runner mill, and these materials were further mixed and agitated for 60 minutes at a linear load of 588 N/cm (60 kg/cm). Thus, the carbon black was made to adhere to the surfaces of silica particles having been coated with methylhydrogenpolysiloxane, followed by drying at 80° C. for minutes by means of a dryer to obtain composite conductive fine particles 1. Here, the agitation was carried out at a rate of 22 rpm. The composite conductive fine particles 1 had an average particle diameter of 15 nm and a volume resistivity of $1.1\times10^2$ Ω·cm.

Production Example 51

Making of Surface-Treated Titanium Oxide Particles:

1,000 parts by mass of acicular rutile type titanium oxide particles (average particle diameter: 15 nm; length/breadth=3:1; volume resistivity: $2.3\times10^{10}$ Ω·cm) was compounded with 110 parts by mass of isobutyltrimethoxysilane as a surface treating agent and 3,000 parts by mass of toluene as a solvent to prepare a slurry. This slurry was mixed for 30 minutes by means of a stirrer, and thereafter fed to Visco mill the effective internal volume of which was filled by 80%, with glass beads of 0.8 mm in average particle diameter, to carry out wet disintegration treatment at a temperature of 35±5° C. The slurry thus obtained by wet disintegration treatment was distilled under reduced pressure by using a kneader (bath temperature: 110° C.; product temperature: 30° C. to 60° C.; degree of reduced pressure: about 100 Torr) to remove the toluene, followed by baking of the surface treating agent at 120° C. for 2 hours. The particles having been treated by baking were cooled to room temperature, and thereafter pulverized by means of a pin mill to obtain surface-treated titanium oxide particles 1.

Production Example 52

Preparation of Conductive Resin Coating Liquid 1:

To caprolactone modified acrylic polyol solution PLACCEL DC2016 (trade name; available from Daicel Chemical Industries, Ltd.), methyl isobutyl ketone was added to adjust the former's solid content to 10% by mass. To 1,000 parts by mass of the solution obtained (100 parts by mass of the acrylic polyol solid content), the following four components were added to prepare a mixture solution.

Composite conductive fine particles (made in Production Example 50): 45 parts by mass Surface-treated titanium oxide particles (made in Production Example 51): 20 parts by mass Modified dimethylsilicone oil (*1): 0.08 part by mass Blocked isocyanate mixture (*2): 80.14 parts by mass Here, the blocked isocyanate mixture was in an amount given by "NCO/OH=1.0" in terms of isocyanate amount.

(*1): modified dimethylsilicone oil "SH28PA" (trade name: available from Dow Corning Toray Silicone Co., Ltd.).

(*2): 7:3 mixture of hexamethylene diisocyanate (HDI) and isophorone diisocyanate (IPDI) each blocked with butanone oxime.

200 parts by mass of the above mixture solution was put into a glass bottle of 450 ml in internal volume together with 200 parts by mass of glass beads of 0.8 mm in average particle diameter as dispersion media, followed by dispersion for 24 hours by using a paint shaker dispersion machine, and then the glass beads were removed to make up a conductive resin coating liquid 1.

Production Example 53

Preparation of Conductive Resin Coating Liquid 2:

A conductive resin coating liquid 2 was prepared in the same way as that in Production Example 52 except that the composite conductive fine particles was changed for carbon black (trade name: #52; available from Mitsubishi Chemical Corporation).

Production Example 54

Preparation of Conductive Resin Coating Liquid 3:

Silicone resin (trade name: SR2360; available from Dow Corning Toray Silicone Co., Ltd.) was so dissolved in methyl ethyl ketone as to be 10% by mass in solid content. Then, to 100 parts by mass of the solid content of the silicone resin, 30 parts by mass of carbon black (trade name: #52; available from Mitsubishi Chemical Corporation) was added to prepare a mixture solution. The subsequent procedure of Production Example 52 was repeated to make up a conductive resin coating liquid 3.

Production Example 55

Preparation of Conductive Resin Coating Liquid 4:

A conductive resin coating liquid 4 was prepared in the same way as that in Production Example 54 except that the mixture solution was prepared by adding methyl ethyl ketone to urethane resin "DF-407" (trade name; available from DIC Corporation) so as to be 8% by mass in solid content.

Production Example 56

Preparation of Conductive Resin Coating Liquid 5:

A conductive resin coating liquid 5 was prepared in the same way as that in Production Example 54 except that the mixture solution was prepared by so adding ethanol to polyvinyl butyral resin "S-LEC B" (trade name; available from Sekisui Chemical Co., Ltd.) as to be 10% by mass in solid content.

Production Examples 57 to 59

Preparation of Conductive Resin Coating Liquids 6 to 8:

Conductive resin coating liquids 6, 7 and 8 were prepared in the same way as those in Production Examples 53, 56 and 55, respectively, except that the carbon black was changed for carbon black "MA100" (trade name; available from Mitsubishi Chemical Corporation).

Production Example 60

Preparation of Conductive Resin Coating Liquid 9:

A mixture solution was prepared in the same way as that in Production Example 52 except that the caprolactone modified acrylic polyol solution was so prepared as to be 17% by mass in solid content. After dispersion carried out for 24 hours, 5 parts by mass of the resin particles 1 were added. Thereafter, the dispersion was carried out for 5 minutes, and then the glass beads were removed to make up a conductive resin coating liquid 9.

Production Example 61

Preparation of Conductive Resin Coating Liquid 10:

A conductive resin coating liquid 10 was prepared in the same way as that in Production Example 60 except that the resin particles 1 were changed for the resin particles 18.

Production Example 62

Preparation of Conductive Resin Coating Liquid 11:
A mixture solution was prepared in the same way as that in Production Example 54. After dispersion carried out for 28 hours, 10 parts by mass of the resin particles 27 were added. Thereafter, the dispersion was carried out for 5 minutes, and then the glass beads were removed to make up a conductive resin coating liquid 11.

Production Example 63

Preparation of Conductive Resin Coating Liquid 12:
A conductive resin coating liquid 12 was prepared in the same way as that in Production Example 62 except that the resin particles 27 were changed for the resin particles 13.

Production Example 64

Preparation of Conductive Resin Coating Liquid 13:
A conductive resin coating liquid 13 was prepared in the same way as that in Production Example 61 except that the resin particles 1 were changed for the resin particles 39, the amount of which was changed to 20 parts by mass.

Production Example 65

Preparation of Conductive Resin Coating Liquid 14:
A conductive resin coating liquid 14 was prepared in the same way as that in Production Example 64 except that the resin particles 39 were changed for the resin particles 40.

Production Example 66

Preparation of Conductive Resin Coating Liquid 15:
A conductive resin coating liquid 15 was prepared in the same way as that in Production Example 62 except that the resin particles 27 were changed for the resin particles 41, the amount of which was changed to 20 parts by mass.

Production Example 67

Preparation of Conductive Resin Coating Liquid 16:
A mixture solution was prepared in the same way as that in Production Example 55. After dispersion carried out for 24 hours, 20 parts by mass of the resin particles 42 were added. Thereafter, the dispersion was carried out for 5 minutes, and then the glass beads were removed to make up a conductive resin coating liquid 16.

Production Example 68

Preparation of Conductive Resin Coating Liquid 17:
A mixture solution was prepared in the same way as that in Production Example 56. After dispersion carried out for 24 hours, 20 parts by mass of the resin particles 43 were added. Thereafter, the dispersion was carried out for 5 minutes, and then the glass beads were removed to make up a conductive resin coating liquid 17.

Production Example 69

Preparation of Conductive Rubber Composition 5:
To 100 parts by mass of epichlorohydrin rubber (EO-EP-AGC terpolymer; EO/EP/AGC=73 mol %/23 mol %/4 mol %), the following seven components were added, and the mixture obtained was kneaded for 10 minutes by means of a closed mixer temperature-controlled at 50° C., to obtain an unvulcanized rubber composition.

Calcium carbonate: 60 parts by mass
Aliphatic polyester type plasticizer: 5 parts by mass
Zinc stearate: 1 part by mass
2-Mercaptobenzimidazole (MB) (age resistor): 0.5 part by mass
Zinc oxide: 5 parts by mass
Quaternary ammonium salt "ADEKACIZER LV70" (trade name; available from Adeka Corporation): 2 parts by mass
Carbon black "THERMAX FLOFORM N990" (trade name; available from Thermax Ltd. Canada; average particle diameter: 270 nm): 5 parts by mass Next, to 178.5 parts by mass of the above unvulcanized rubber composition, 1.2 parts by mass of sulfur as a vulcanizing agent, and as vulcanization accelerators 1 part by mass of dibenzothiazyl sulfide (DM) and 1 part by mass of tetramethylthiuram monosulfide (TS) were added. Then, these were kneaded for 10 minutes by means of a twin-roll mill kept cooled to 20° C., to obtain a conductive rubber composition 5.

Example 1

Example 1 is concerned with a charging roller having a conductive substrate and provided thereon a first conductive resin layer and a second conductive resin layer in this order as shown in FIG. 1B.

Conductive Substrate:
A substrate made of stainless steel of 6 mm in diameter and 252.5 mm in length and coated with a thermosetting adhesive incorporated with 10% by mass of carbon black was used as the conductive substrate.

Figure 7:
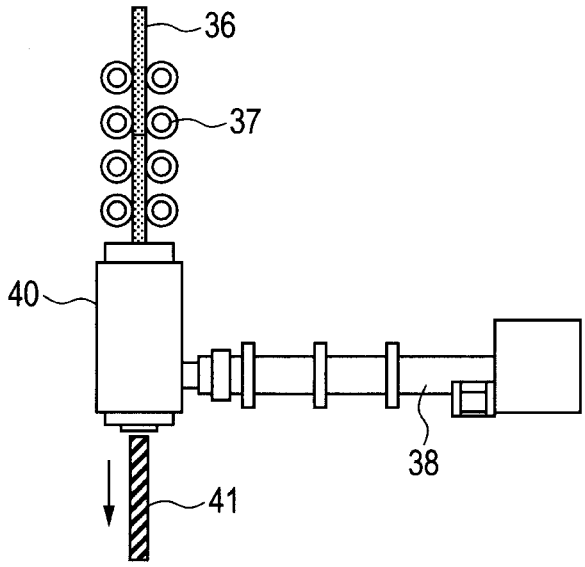
FIG. 7 is a sectional view of a cross-head extrusion equipment used in producing a charging roller.

Formation of First Conductive Resin Layer:
Using an extrusion equipment having a cross-head as shown in FIG. 7, the conductive substrate was, around its axis, coaxially covered with the conductive rubber composition 1 prepared in Production Example 46. The conductive rubber composition was controlled to be of 1.75 mm in thickness to form an elastic-material layer. In FIG. 7, reference numeral 36 denotes the conductive substrate; 37, feed rollers; 38, an extruder; 40, the cross-head; and 41, a roller formed upon extrusion. The roller formed upon extrusion was heated at 160° C. for 1 hour by means of a hot-air oven, and thereafter ends of the elastic-material layer were removed to make it be 224.2 mm in length. This was further secondarily heated at 160° C. for 1 hour to produce a roller having a preliminary cover layer of 3.5 mm in layer thickness as the first conductive resin layer.

The roller obtained was sanded on its outer peripheral surface by means of a cylindrical sander of a plunge cutting system. As its sand grinding wheel, a vitrified grinding wheel was used, and abrasive grains were green silicon carbide (GC) particles having a particle size of 100 meshes. The roller was set at a number of revolutions of 350 rpm, and the sand grinding wheel was set at a number of revolutions of 2,050 rpm. The rotational direction of the roller and the rotational direction of the sand grinding wheel were set in the same directions (follow-up directions). The rate of cut was set at 20 mm/min and the spark-out time (the time at a cut of 0 mm) was set at 0 second to carryout the sanding to produce an elastic roller 1 having the first conductive resin layer. The resin layer was controlled to be of 3 mm in thickness. Here, the crown level (the difference in external diameter between that at the middle portion and that at positions 90 mm away from the middle portion) of the roller was 120 μm.

Formation of Second Conductive Resin Layer:
This elastic roller 1 was coated thereon with the conductive resin coating liquid 1 by dipping once. Here, as conditions for the dipping, dipping time was set to be 9 seconds, the rate of draw-up from the conductive resin coating liquid was set at 20 mm/s for initial-stage rate and 2 mm/s for end rate. Changes in rate from the initial-stage rate to the end rate were made linearly with respect to the time. The elastic roller 1 having been drawn up from the conductive resin coating liquid was air-dried at normal temperature for 30 minutes, and thereafter dried by means of a drier with internal air circulation at a temperature of 80° C. for 1 hour and further at a temperature of 160° C. for 1 hour to obtain a charging roller 1.

The charging roller 1 thus obtained was evaluated on the following items 1 to 6.

Figure 5:
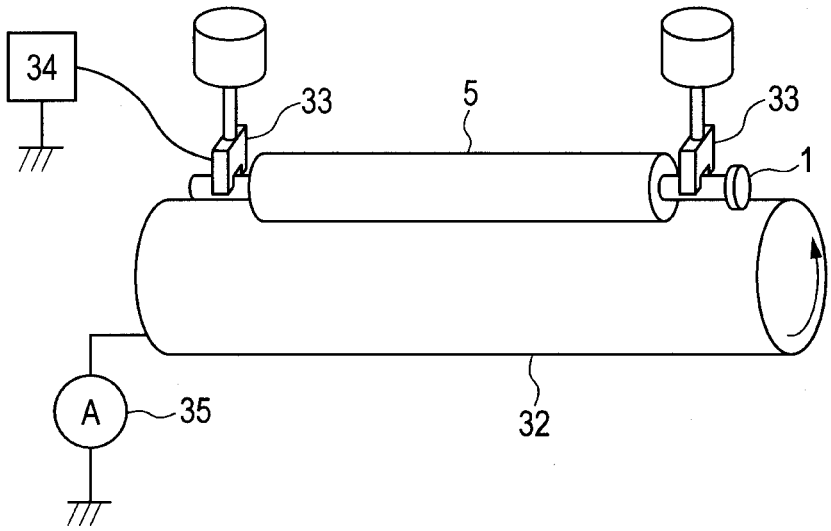
FIG. 5 is a view of an instrument for measuring the electrical resistance value of a charging roller.

1. Electrical Resistance Value of Charging Member:
FIG. 5 shows an instrument for measuring the electrical resistance value of the charging roller. By the aid of bearings 33 and 33 through which a load is kept applied to both end portions of a conductive substrate 1, the charging roller is brought into contact with a cylindrical metal 32 having the same curvature radius as the electrophotographic photosensitive member, in such a way that the former is in parallel to the latter. In this state, the cylindrical metal 32 is rotated by means of a motor (not shown) and, while the charging roller is follow-up rotated, a DC voltage of −200 V is applied thereto from a stabilized power source 34. Electric current flowing at this point to the charging roller is measured with an ammeter 35, and the resistance value of the charging roller is calculated. The load is set to be 4.9 N at each end portion. The cylinder made of metal is 30 mm in diameter, and is so set as to be rotated at a peripheral speed of 45 mm/second.

2. Measurement of Surface Roughness Rzjis and Surface Hill-to-Dale Average Distance R Sm of Charging Member:
These are measured with a surface profile analyzer (trade name: SE-3500; manufactured by Kosaka Laboratory Ltd.) and according to Japan Industrial Standards (JIS) B 0601-1994. The Rzjis is an average value of values found by measuring the surface of the charging roller at 6 spots picked up at random. Also, the Sm is a value found by finding an average value of ten-point measured values at 6 spots picked up at random on the surface of the charging roller and then found as an average value at the 6 spots. In measuring these, cut-off value is set to be 8 mm, and standard length 0.8 mm.

3. Shape Measurement for Bowl-Shaped Resin Particles:
The conductive resin layer is cut out at its arbitrary spots at intervals of 20 nm over the length of 500 μm by using a focused ion beam processing observation instrument (trade name: FB-2000C; manufactured by Hitachi Ltd.), and their sectional images are photographed. Then, images in which resin particles having the like bowl shapes are photographed are combined to calculate stereoscopic images of such bowl-shaped resin particles. From the stereoscopic images, maximum diameter 58 as shown in FIG. 3 and minimum diameter 74 of openings shown in FIG. 4A to 4E are calculated. Differences between outer diameter and inner diameter at any arbitrary five spots of the bowl-shaped resin particles are also calculated from the above stereoscopic images. Such is operated about 10 resin particles present within the visual field. Then, the like measurement is made at 10 spots in the lengthwise direction of the charging member, and an average value of measured values found on 100 resin particles in total is calculated.

4. Measurement of Differences in Height Between Tops of Protrusions and Bottoms of Concavities on the Charging Member Surface:
The charging member surface is observed on a laser microscope (trade name: LXM5 PASCAL; manufactured by Carl Zeiss, Inc.) in the visual field of 0.5 mm in length and 0.5 mm in width. Its laser is scanned over the X-Y plane within the visual field to obtain two-dimensional image data, and further its focus is moved in the Z direction, where the above scanning is repeated to obtain three-dimensional image data. As the result, it can be ascertained that the surface has the concavities derived from the openings of the bowl-shaped resin particles and the protrusions derived from the edges of the openings of the bowl-shaped resin particles. Further, differences in height between tops 55 of the protrusions 54 and bottoms 56 of the concavities are calculated. Such is operated about two bowl-shaped resin particles present within the visual field. Then, the like measurement is made at 50 spots in the lengthwise direction of the charging member, and an average value of measured values found on 100 resin particles in total is calculated.

5. Running Evaluation 1:
A monochrome laser beam printer (LASER JET P4515n, trade name) manufactured by Hewlett-Packard Co., which was an electrophotographic apparatus set up as shown in FIG. 6, was used, and voltages were applied to its charging member from the outside. The voltages applied were a peak-to-peak voltage (Vpp) of 1,800 V as AC voltage, having a frequency (f) of 2,930 Hz, and DC voltage (Vdc) of −600V. Images were reproduced at a resolution of 600 dpi. Here, a process cartridge for the above printer was used as a process cartridge. A charging roller attached was detached from this process cartridge, and instead the charging roller 1 produced was set therein. Also, the charging roller 1 was brought into pressure contact with the electrophotographic photosensitive member at the former's spring-loaded pressing force of 4.9 N at each end portion, i.e., at 9.8 N at both end portions in total. The charging roller 1 was set in the above process cartridge, and this process cartridge was allowed to adapt itself to three environments of an environment of 15° C./10% RH (environment 1), an environment of temperature 23° C./humidity 50% RH (environment 2) and an environment of temperature 32.5° C./humidity 80% RH (environment 3) for 24 hours each. Thereafter, running evaluation was made in each environment.

Stated specifically, images of horizontal-line images of two dots in width and 176 dots in space in the direction perpendicular to the rotational direction of the electrophotographic photosensitive member were outputted two-sheet intermittently (running in such a way that the rotation of the printer was stopped every two sheets for 3 seconds) to conduct a test. On the way of the running (at completion of 18,000-sheet running, at completion of 24,000-sheet running, at completion of 30,000-sheet running and at completion of 36,000-sheet running), halftone images (images drawn in horizontal lines of one dot in width and two dots in space in the direction perpendicular to the rotational direction of the electrophotographic photosensitive member) were outputted to make evaluation. Here, the evaluation was made by observing the halftone images visually to examine whether or not any dot-like, horizontal line-like or vertical line-like image defects were seen, to make evaluation according to the following criteria.

Rank 1: Any dot-like, horizontal line-like and vertical line-like image defects are not seen.

Rank 2: Dot-like, horizontal line-like or vertical line-like image defects are slightly seen.

Rank 3: Dot-like and horizontal line-like image defects are seen to have occurred correspondingly to the rotational pitches of the charging roller. Vertical line-like image defects are also seen to have occurred at some part.

Rank 4: Dot-like, horizontal line-like and vertical line-like image defects are conspicuously seen.

6. Running Evaluation 2:

A monochrome laser beam printer (LASER JET P4014n, trade name) manufactured by Hewlett-Packard Co., which was an electrophotographic apparatus set up as shown in FIG. 6, was used, and voltages were applied to its charging member from the outside. Primary charging was set at an output of a DC voltage of −1,100V, and images were reproduced at a resolution of 600 dpi. A process cartridge for the above printer was used as a process cartridge. Images were evaluated in the same way as those in the running evaluation 1 except that images reproduced on the way of the running (at completion of 6,000-sheet running, at completion of 9,000-sheet running, at completion of 12,000-sheet running and at completion of 15,000-sheet running) were evaluated. In the charging member of this Example, any dot-like, horizontal line-like and vertical line-like image defects did not occur to obtain good images.

Results of Evaluation:

The charging roller 1 had an electrical resistance value of $6.7\times10^5\Omega$. Also, the charging roller 1 was 30 μm in Rzjis and 80 μm in Sm. The results of these are shown in Table 1-1.

The bowl-shaped resin particles at the surface of the charging roller 1 were 50 μm in maximum diameter, 32 μm in minimum diameter of the openings, and 0.5 μm in difference between outer diameter and inner diameter. The concavities derived from the openings of the bowl-shaped resin particles and the protrusions derived from the edges of the openings of the same were formed on the surface of the charging roller 1. Then, the bowl-shaped resin particles were 35 μm in difference in height between the tops of the protrusions and the bottoms of the concavities. The results of these are shown in Table 2-1. The results of the running evaluation 1 and running evaluation 2 of the charging roller 1 are also shown in Table 3-1.

Example 2

A conductive rubber composition 6 was prepared in the same way as that in Production Example 46 except that the resin particles 1 were changed for the resin particles 2. A charging roller 2 was produced in the same way as that in Example 1 except that the conductive rubber composition 6 was used in place of the conductive rubber composition 1 and also, in forming the second conductive resin layer, the conductive resin coating liquid 2 was used in place of the conductive resin coating liquid 1.

Examples 3 to 9

Charging rollers 3 to 9 were produced in the same way as in Example 2 except that the types and amounts of the resin particles added were changed as shown in Table 1-1.

Example 10

An elastic roller 10 was produced in the same way as that in Example 2 except that the conductive rubber composition was changed for the conductive rubber composition 2, prepared in Production Example 47, and on that occasion the rate of cut was changed to 30 mm/min. A charging roller 10 was produced in the same way as that in Example 2 except for the above.

Example 11

A charging roller 11 was produced in the same way as that in Example 2 except that the resin particles 1 were changed for the resin particles 8 and the spark-out time was changed to 1 second.

Example 12

An elastic roller 12 was produced in the same way as that in Example 10 except that the resin particles 6 were changed for the resin particles 8, the amount of which was changed to 12 parts by mass, and the spark-out time was changed to 1 second. Thereafter, a charging roller 12 was produced in the same way as that in Example 10 except that, in forming the second conductive resin layer, the conductive resin coating liquid 3 was used instead and the roller coated therewith was not dried at a temperature of 160° C. for 1 hour.

Example 13

A charging roller 13 was produced in the same way as that in Example 12 except that the resin particles 8 were changed for the resin particles 9 and the rate of cut was changed to 10 mm/min.

Example 14

A charging roller 14 was produced in the same way as that in Example 13 except that the resin particles 9 were changed for the resin particles 10 and that, in forming the second conductive resin layer, the conductive resin coating liquid 4 was used instead and the roller coated therewith was not dried at a temperature of 160° C. for 1 hour.

Example 15

A charging roller 15 was produced in the same way as that in Example 14 except that the resin particles 10 were changed for the resin particles 11, the amount of which was changed to 15 parts by mass.

Example 16

A charging roller 16 was produced in the same way as that in Example 1 except that the resin particles 1 were changed for the resin particles 12, the amount of which was changed to 8 parts by mass.

Examples 17 to 21

Charging rollers 17 to 21 were produced in the same way as in Example 16 except that the resin particles 12 were each added in an amount changed as shown in Table 1-1.

Example 22

A charging roller 22 was produced in the same way as that in Example 2 except that the resin particles 1 were changed for the resin particles 13, the amount of which was changed to 10 parts by mass, the rate of cut was changed to 10 mm/min and the spark-out time was changed to 2 seconds.

Example 23

A charging roller 23 was produced in the same way as that in Example 13 except that the resin particles 9 were changed for the resin particles 14, the amount of which was changed to 15 parts by mass, the rate of cut was changed to 30 mm/min and the spark-out time was changed to 2 seconds.

Example 24

An elastic roller 24 was produced in the same way as that in Example 23 except that the resin particles 14 were changed for the resin particles 13, the amount of which was changed to 10 parts by mass, and the rate of cut was changed to 10 mm/min. Thereafter, a charging roller 24 was produced in the same way as that in Example 23 except that, in forming the second conductive resin layer, the conductive resin coating liquid 5 was used instead.

Example 25

A charging roller 25 was produced in the same way as that in Example 24 except that the resin particles 13 were changed for the resin particles 15, the amount of which was changed to 10 parts by mass, and the spark-out time was changed to 1 second.

Example 26

An elastic roller 26 was produced in the same way as that in Example 7 except that the resin particles were added in an amount changed to 5 parts by mass, the rate of cut was changed to 10 mm/min and the spark-out time was changed to 3 seconds. Thereafter, a charging roller 26 was produced in the same way as that in Example 7 except that, in forming the second conductive resin layer, the conductive resin coating liquid 4 was used instead and the roller coated therewith was not dried at a temperature of 160° C. for 1 hour.

Example 27

A charging roller 27 was produced in the same way as that in Example 12 except that the resin particles 8 were changed for the resin particles 6, the amount of which was changed to 10 parts by mass, the rate of cut was changed to 20 mm/min and the spark-out time was changed to 0 second.

Example 28

A charging roller 28 was produced in the same way as that in Example 10 except that the resin particles 6 were changed for the resin particles 1, the amount of which was changed to 8 parts by mass, the rate of cut was changed to 10 mm/min and the spark-out time was changed to 1 second.

Example 29

A charging roller 29 was produced in the same way as that in Example 10 except that the resin particles 6 were changed for the resin particles 16, the amount of which was changed to 12 parts by mass, and the rate of cut was changed to 20 mm/min.

Example 30

A charging roller 30 was produced in the same way as that in Example 26 except that the resin particles 6 were changed for the resin particles 16, the amount of which was changed to 9 parts by mass, and the spark-out time was changed to 1 second.

Example 31

An elastic roller 31 was produced in the same way as that in Example 30 except that the resin particles 16 were changed for the resin particles 17, the amount of which was changed to 12 parts by mass. A charging roller 31 was produced in the same way as that in Example 30 except that, in forming the second conductive resin layer, the conductive resin coating liquid 3 was used instead and the roller coated therewith was not dried at a temperature of 160° C. for 1 hour.

Example 32

A charging roller 32 was produced in the same way as that in Example 14 except that the resin particles 10 were changed for the resin particles 18, the amount of which was changed to 9 parts by mass, and the spark-out time was changed to 2 seconds.

Example 33

A charging roller 33 was produced in the same way as that in Example 24 except that the resin particles 13 were changed for the resin particles 27, the amount of which was changed to 15 parts by mass.

Example 34

A charging roller 34 was produced in the same way as that in Example 2 except that the resin particles 2 were changed for the resin particles 28, the amount of which was changed to 9 parts by mass, the rate of cut was changed to 5 mm/min and the spark-out time was changed to 2 seconds.

Example 35

A charging roller 35 was produced in the same way as that in Example 26 except that the resin particles 6 were changed for the resin particles 29, the amount of which was changed to 20 parts by mass, the rate of cut was changed to 20 mm/min and the spark-out time was changed to 0 second.

Example 36

A charging roller 36 was produced in the same way as that in Example 33 except that the resin particles 27 were changed for the resin particles 30, the amount of which was changed to 8 parts by mass, the rate of cut was changed to 5 mm/min and the spark-out time was changed to 3 seconds.

Example 37

An elastic roller 37 was produced in the same way as that in Example 2 except that the conductive rubber composition was changed for the conductive rubber composition 3, prepared in Production Example 48. On that occasion, the rate of cut was changed to 10 mm/min and the spark-out time was changed to 2 seconds. A charging roller 37 was produced in the same way as that in Example 2 except that, in forming the second conductive resin layer, the conductive resin coating liquid 6 was used instead and the roller coated therewith was not dried at a temperature of 160° C. for 1 hour.

Example 38

An elastic roller 38 was produced in the same way as that in Example 2 except that the resin particles 2 were changed for the resin particles 32, the amount of which was changed to 20 parts by mass. A charging roller 38 was produced in the same way as that in Example 2 except that, in forming the second conductive resin layer, the conductive resin coating liquid 6 was used instead and the roller coated therewith was not dried at a temperature of 160° C. for 1 hour.

Example 39

A charging roller 39 was produced in the same way as that in Example 37 except that the resin particles 31 were changed for the resin particles 33, the amount of which was changed to 20 parts by mass, the rate of cut was changed to 30 mm/min and the spark-out time was changed to 0 second and further that, in forming the second conductive resin layer, the conductive resin coating liquid 4 was used instead and the roller coated therewith was not dried at a temperature of 160° C. for 1 hour.

Example 40

A charging roller 40 was produced in the same way as that in Example 36 except that the resin particles 30 were changed for the resin particles 34 and, in forming the second conductive resin layer, the conductive resin coating liquid 4 was used instead.

Example 41

A charging roller 41 was produced in the same way as that in Example 39 except that, in Example 39, the resin particles 33 were changed for the resin particles 35, the amount of which was changed to 5 parts by mass, the rate of cut was changed to 5 mm/min and the spark-out time was changed to 3 seconds and further that, in forming the second conductive resin layer, the conductive resin coating liquid 7 was used instead.

Example 42

A charging roller 42 was produced in the same way as that in Example 37 except that, in Example 37, the resin particles 31 were changed for the resin particles 36, the amount of which was changed to 15 parts by mass and the rate of cut was changed to 20 mm/min and further that, in forming the second conductive resin layer, the conductive resin coating liquid 8 was used instead.

Example 43

A charging roller 42 was produced in the same way as that in Example 6 except that the resin particles 5 were changed for the resin particles 37 and, in forming the second conductive resin layer, the conductive resin coating liquid 8 was used instead and the roller coated therewith was not dried at a temperature of 160° C. for 1 hour.

Example 44

A charging roller 44 was produced in the same way as that in Example 42 except that the resin particles 36 were changed for the resin particles 38, the amount of which was changed to 10 parts by mass, the spark-out time was changed to 0 second and, in forming the second conductive resin layer, the conductive resin coating liquid 5 was used instead.

Example 45

Example 45 is concerned with a charging roller having a conductive substrate and provided thereon a conductive elastic layer, a first conductive resin layer and a second conductive resin layer in this order as shown in FIG. 1D.

Formation of conductive elastic layer and first conductive resin layer:

A roller 45 having a conductive elastic layer was produced in the same way as the way of producing the roller having the first conductive resin layer in Example 1 except that a conductive rubber composition was used which was obtained by removing the resin particles 1 from the conductive rubber composition 1. When the conductive substrate was covered with the conductive rubber composition, the thickness of the conductive rubber composition was so controlled as to be 3.25 mm.

Next, using the conductive resin coating liquid 9, the roller 45 having a conductive elastic layer thus produced was coated therewith by dipping once. This was air-dried at normal temperature for 30 minutes or more, and thereafter dried by means of a drier with internal air circulation at a temperature of 80° C. for 1 hour and further at a temperature of 160° C. for 1 hour. Here, conditions for the dip coating were the same as the conditions in Example 1. The conductive resin layer formed using the conductive resin coating liquid 9 was in a layer thickness of 10 μm.

Subsequently, the roller obtained was sanded by tape sanding. As a sanding equipment, a film system super finishing equipment SUPER FINISHER SP100 Model (manufactured by Matsuda Seiki Co.) was used. As a sanding tape, Lapping Film (available from Sumitomo 3M Limited; sanding abrasive grains: aluminum oxide; average particle diameter: 12 μm, #1200) was used. The rate of roller lengthwise movement of the sanding tape was set at 200 mm/min; the number of revolution of roller, 500 rpm; the sanding tape pressing force, a pressure of 0.2 MPa; the rate of sanding tape feeding, 40 mm/min; and the rate of oscillation, 500 cycle/min. The sanding tape and the roller were rotated in the opposite directions (the counter directions). Thus, an elastic roller 45 having the conductive elastic layer and first conductive resin layer was produced.

Formation of Second Conductive Resin Layer:

A second conductive resin layer was formed in the same way as that in Example 1 to produce a charging roller 45.

Example 46

A charging roller 46 was produced in the same way as that in Example 45 except that the conductive resin coating liquid 9 was changed for the conductive resin coating liquid 10. Here, the conductive resin layer formed using the conductive resin coating liquid 10 was in a layer thickness of 11 μm.

Example 47

An elastic roller 47 having a conductive elastic layer was produced in the same way as that in Example 10 except that the resin particles were not added. The way of producing it was the same as that in Example 45.

Subsequently, an elastic roller 47 was produced in the same way as that in Example 45 except that the conductive resin coating liquid 9 was changed for the conductive resin coating liquid 11. Here, the conductive resin layer formed using the conductive resin coating liquid 11 was in a layer thickness of 12 μm. Thereafter, the second conductive resin layer was formed in the same way as that in Example 2 to produce a charging roller 47.

Example 48

An elastic roller 48 was produced in the same way as that in Example 47 except that the conductive resin coating liquid 11 was changed for the conductive resin coating liquid 12. Here, the conductive resin layer formed using the conductive resin coating liquid 12 was in a layer thickness of 12 μm. Thereafter, the second conductive resin layer was formed in the same way as that in Example 47 except that the conductive resin coating liquid 2 was changed for the conductive resin coating liquid 4, to produce a charging roller 48.

Example 49

Formation of Conductive Elastic Layer:
An elastic roller 49 having a conductive elastic layer was produced in the same way as that in Example 45 except that the conductive rubber composition was changed for the conductive rubber composition 5, prepared in Production Example 69.

Formation of Conductive Resin Layer:
This elastic roller 49 was coated with the conductive resin coating liquid 13 by dipping once. This was air-dried at normal temperature for 1 minute, and thereafter dried by means of a drier with internal air circulation at a temperature of 40° C. for 30 minutes, then at a temperature of 80° C. for 30 minutes and further at a temperature of 150° C. for 1 hour to produce a charging roller 49 having a conductive resin layer on the conductive elastic layer. Here, conditions for the dip coating were the same as the conditions in Example 45.

Example 50

A charging roller 50 was produced in the same way as that in Example 49 except that the conductive resin coating liquid 13 was changed for the conductive resin coating liquid 14.

Example 51

A roller 51 having a conductive elastic layer was produced in the same way as that in Example 45. A charging roller 51 was then produced in the same way as that in Example 50 except that the conductive resin coating liquid 13 was changed for the conductive resin coating liquid 15 and the roller coated therewith was not dried at a temperature of 150° C. for 1 hour.

Example 52

A charging roller 52 was produced in the same way as that in Example 51 except that the conductive resin coating liquid 15 was changed for the conductive resin coating liquid 16.

Example 53

An elastic roller 53 having a conductive elastic layer was produced in the same way as that in Example 47. Subsequently, a charging roller 53 was then produced in the same way as that in Example 52 except that the conductive resin coating liquid 16 was changed for the conductive resin coating liquid 17.

Comparative Example 1

An elastic roller 54 was produced in the same way as that in Example 44 except that the conductive rubber composition was changed for the conductive rubber composition 4, prepared in Production Example 49. On that occasion, the rate of cut was changed to such conditions that it was stepwise changed from 10 mm/min to 0.1 mm/min after the grinding wheel came into contact with the unsanded roller and until the roller was shaped into a roller of 12 mm in diameter, and the spark-out time was changed to 10 seconds. In this Comparative Example, this elastic roller 54 was used as it was as a charging roller 54. The charging roller 54 did not have any protrusions on the roller surface.

Comparative Example 2

An elastic roller 55 was produced in the same way as that in Comparative Example 1 except that the resin particles 27 were changed for the resin particles 44, the amount of which was changed to 5 parts by mass. Then, the second conductive resin layer was formed in the same way as that in Example 43 to obtain a charging roller 55. The charging roller 55 did not have any protrusions on the roller surface.

Comparative Example 3

A charging roller 56 was produced in the same way as that in Comparative Example 2 except that the resin particles 44 were added in an amount changed to 10 parts by mass. The charging roller 56 did not have any protrusions on the roller surface.

Comparative Example 4

A charging roller 57 was produced in the same way as that in Example 25 except that the resin particles 5 were changed for the resin particles 45, the amount of which was changed to 3 parts by mass and the sanding was carried out under the same conditions as that in Comparative Example 3. The charging roller 57 did not have any protrusions on the roller surface.

Comparative Example 5

A charging roller 58 was produced in the same way as that in Example 2 except that the resin particles 2 were not added and 15 parts by mass of ADCA (azodicarbonamide) was added as a blowing agent.

Comparative Example 6

A charging roller 59 was produced in the same way as that in Comparative Example 5 except that the blowing agent was not added. When the conductive substrate was covered with the conductive rubber composition, the thickness of the conductive rubber composition was so controlled as to be 3.25 mm.

Comparative Example 7

The elastic roller 44, produced in Example 44, was used as a charging roller 60.

Comparative Example 8

A charging roller 61 was produced in the same way as that in Example 44 except that the resin particles were not added. When the conductive substrate was covered with the conductive rubber composition, the thickness of the conductive rubber composition was so controlled as to be 3.25 mm.

Comparative Example 9

A charging roller 62 was produced in the same way as that in Example 53 except that the resin particles 43 were changed for sphere-shaped polymethyl methacrylate resin particles (average particle diameter: 20 μm).

About the charging rollers 2 to 62 according to Examples 2 to 53 and Comparative Examples 1 to 9, the measurement and evaluation were each made in the same way as those in Example 1. The results are shown in Tables 1-1 to 1-3, Tables 2-1 and 2-2 and Tables 3-1 and 3-2.

TABLE 1-1

| Example | Charging roller No. | Resin particles Type | Resin particles Amount (pbm) | Conductive resin coating liquid | Roller resistance (Ω) | Surface roughness Rz (μm) | Surface roughness Sm (μm) |
|---|---|---|---|---|---|---|---|
| 1 | 1 | 1 | 12 | 1 | $6.7 \times 10^5$ | 30 | 80 |
| 2 | 2 | 2 | 12 | 2 | $5.4 \times 10^5$ | 50 | 100 |
| 3 | 3 | 1 | 10 | 2 | $6.4 \times 10^5$ | 35 | 100 |
| 4 | 4 | 3 | 15 | 2 | $6.6 \times 10^5$ | 61 | 100 |
| 5 | 5 | 4 | 8 | 2 | $5.3 \times 10^5$ | 21 | 100 |
| 6 | 6 | 5 | 5 | 2 | $5.8 \times 10^5$ | 12 | 100 |
| 7 | 7 | 6 | 10 | 2 | $7.6 \times 10^5$ | 48 | 120 |
| 8 | 8 | 7 | 20 | 2 | $2.0 \times 10^6$ | 18 | 60 |
| 9 | 9 | 5 | 10 | 2 | $8.9 \times 10^5$ | 16 | 50 |
| 10 | 10 | 6 | 20 | 2 | $3.0 \times 10^6$ | 46 | 55 |
| 11 | 11 | 8 | 12 | 2 | $5.5 \times 10^5$ | 25 | 120 |
| 12 | 12 | 8 | 12 | 3 | $1.2 \times 10^5$ | 35 | 90 |
| 13 | 13 | 9 | 20 | 3 | $1.7 \times 10^5$ | 13 | 45 |
| 14 | 14 | 10 | 20 | 4 | $4.3 \times 10^5$ | 25 | 65 |
| 15 | 15 | 11 | 15 | 4 | $4.1 \times 10^5$ | 60 | 197 |
| 16 | 16 | 12 | 8 | 1 | $5.4 \times 10^5$ | 32 | 150 |
| 17 | 17 | 12 | 5 | 1 | $7.8 \times 10^5$ | 30 | 170 |
| 18 | 18 | 12 | 12 | 1 | $8.9 \times 10^5$ | 30 | 130 |
| 19 | 19 | 12 | 15 | 1 | $9.0 \times 10^5$ | 30 | 100 |
| 20 | 20 | 12 | 18 | 1 | $8.2 \times 10^5$ | 30 | 60 |
| 21 | 21 | 12 | 20 | 1 | $9.5 \times 10^5$ | 30 | 30 |
| 22 | 22 | 13 | 10 | 2 | $4.7 \times 10^5$ | 20 | 80 |
| 23 | 23 | 14 | 15 | 3 | $2.1 \times 10^5$ | 41 | 60 |
| 24 | 24 | 13 | 10 | 5 | $1.2 \times 10^6$ | 15 | 110 |
| 25 | 25 | 15 | 10 | 5 | $1.8 \times 10^6$ | 43 | 120 |
| 26 | 26 | 6 | 5 | 4 | $3.2 \times 10^5$ | 48 | 195 |
| 27 | 27 | 6 | 10 | 3 | $3.2 \times 10^5$ | 45 | 140 |
| 28 | 28 | 1 | 8 | 2 | $5.4 \times 10^5$ | 28 | 120 |
| 29 | 29 | 16 | 12 | 2 | $4.9 \times 10^5$ | 45 | 100 |
| 30 | 30 | 16 | 9 | 4 | $4.3 \times 10^5$ | 48 | 160 |

TABLE 1-2

| Example | Charging roller No. | Resin particles Type | Resin particles Amount (pbm) | Conductive resin coating liquid | Roller resistance (Ω) | Surface roughness Rz (μm) | Surface roughness Sm μm) |
|---|---|---|---|---|---|---|---|
| 31 | 31 | 17 | 12 | 3 | $2.2 \times 10^5$ | 50 | 150 |
| 32 | 32 | 18 | 9 | 4 | $2.1 \times 10^5$ | 34 | 170 |
| 33 | 33 | 27 | 15 | 5 | $1.5 \times 10^6$ | 8 | 45 |
| 34 | 34 | 28 | 9 | 2 | $4.3 \times 10^5$ | 23 | 136 |
| 35 | 35 | 29 | 20 | 4 | $5.2 \times 10^5$ | 30 | 45 |
| 36 | 36 | 30 | 8 | 5 | $1.6 \times 10^6$ | 20 | 160 |
| 37 | 37 | 31 | 8 | 6 | $4.3 \times 10^6$ | 35 | 139 |
| 38 | 38 | 32 | 20 | 6 | $3.2 \times 10^6$ | 35 | 65 |
| 39 | 39 | 33 | 15 | 4 | $2.1 \times 10^5$ | 55 | 60 |
| 40 | 40 | 34 | 8 | 4 | $3.4 \times 10^5$ | 15 | 148 |
| 41 | 41 | 35 | 5 | 7 | $3.2 \times 10^6$ | 10 | 150 |
| 42 | 42 | 36 | 15 | 8 | $6.7 \times 10^6$ | 48 | 72 |
| 43 | 43 | 37 | 5 | 8 | $8.4 \times 10^6$ | 56 | 120 |
| 44 | 44 | 38 | 10 | 5 | $2.1 \times 10^6$ | 55 | 90 |
| 45 | 45 | 1 | 5 | 9 | $2.1 \times 10^6$ | 33 | 90 |
| 46 | 46 | 18 | 5 | 10 | $1.8 \times 10^6$ | 38 | 130 |
| 47 | 47 | 27 | 10 | 11 | $3.7 \times 10^6$ | 8 | 45 |
| 48 | 48 | 13 | 10 | 12 | $3.6 \times 10^6$ | 25 | 80 |
| 49 | 49 | 39 | 20 | 13 | $1.3 \times 10^5$ | 20 | 80 |
| 50 | 50 | 40 | 20 | 14 | $1.7 \times 10^5$ | 5.3 | 30 |
| 51 | 51 | 41 | 20 | 15 | $1.9 \times 10^5$ | 15.6 | 50 |
| 52 | 52 | 42 | 20 | 16 | $1.5 \times 10^5$ | 10 | 70 |
| 53 | 53 | 43 | 20 | 17 | $1.4 \times 10^5$ | 5.3 | 100 |

TABLE 1-3

| Comparative Example | Charging roller No. | Resin particles Type | Resin particles Amount (pbm) | Conductive resin coating liquid | Roller resistance (Ω) | Surface roughness Rz (μm) | Surface roughness Sm (μm) |
|---|---|---|---|---|---|---|---|
| 1 | 54 | 27 | 3 | — | $8.7 \times 10^5$ | 55.3 | 180 |
| 2 | 55 | 44 | 5 | 8 | $5.3 \times 10^6$ | 53 | 170 |
| 3 | 56 | 44 | 10 | 8 | $4.3 \times 10^6$ | 60 | 130 |
| 4 | 57 | 45 | 3 | 5 | $2.1 \times 10^6$ | 62 | 170 |
| 5 | 58 | — | — | 2 | $2.3 \times 10^4$ | 100 | 210 |
| 6 | 59 | — | — | 2 | $3.2 \times 10^4$ | 5 | 194 |
| 7 | 60 | 38 | 5 | — | $9.9 \times 10^4$ | 58 | 93 |
| 8 | 61 | — | — | 5 | $1.8 \times 10^4$ | 8 | 180 |
| 9 | 62 | PMMA | 20 | — | $1.3 \times 10^5$ | 20 | 50 |

TABLE 2-1

| Example | Height difference (μm) | Max. diam. (μm) | Mini. diam. of openings (μm) | Diff. betwn outer diam. and inner diam. (μm) | (Max. diam.)/(height diff.) | (Max. diam.)/(mini. diam. of openings) |
|---|---|---|---|---|---|---|
| 1 | 35 | 50 | 32 | 0.5 | 1.43 | 1.56 |
| 2 | 50 | 100 | 60 | 0.8 | 2.00 | 1.67 |
| 3 | 38 | 50 | 28 | 0.3 | 1.32 | 1.79 |
| 4 | 75 | 120 | 100 | 1.2 | 1.60 | 1.20 |
| 5 | 27 | 35 | 15 | 0.5 | 1.30 | 2.33 |
| 6 | 20 | 17 | 13 | 0.1 | 0.85 | 1.31 |
| 7 | 49 | 89 | 65 | 0.3 | 1.82 | 1.37 |
| 8 | 20 | 30 | 14 | 0.8 | 1.50 | 2.14 |
| 9 | 20 | 20 | 15 | 0.9 | 1.00 | 1.33 |
| 10 | 55 | 86 | 45 | 0.5 | 1.56 | 1.91 |
| 11 | 28 | 60 | 45 | 0.6 | 2.14 | 1.33 |
| 12 | 40 | 63 | 34 | 0.5 | 1.58 | 1.85 |
| 13 | 16 | 20 | 13 | 1 | 1.25 | 1.54 |
| 14 | 32 | 33 | 23 | 1.2 | 1.03 | 1.43 |
| 15 | 80 | 110 | 89 | 2 | 1.38 | 1.24 |
| 16 | 43 | 53 | 33 | 0.4 | 1.23 | 1.61 |
| 17 | 40 | 53 | 35 | 0.4 | 1.33 | 1.51 |
| 18 | 40 | 53 | 32 | 0.4 | 1.33 | 1.66 |
| 19 | 40 | 53 | 26 | 0.4 | 1.33 | 2.04 |
| 20 | 40 | 53 | 31 | 0.4 | 1.33 | 1.71 |
| 21 | 40 | 53 | 32 | 0.4 | 1.33 | 1.66 |
| 22 | 25 | 32 | 23 | 0.5 | 1.28 | 1.39 |
| 23 | 55 | 67 | 34 | 0.6 | 1.22 | 1.97 |
| 24 | 18 | 28 | 23 | 0.9 | 1.56 | 1.22 |
| 25 | 48 | 74 | 35 | 0.8 | 1.54 | 2.11 |
| 26 | 50 | 89 | 79 | 1.5 | 1.78 | 1.13 |
| 27 | 49 | 70 | 40 | 1.3 | 1.43 | 1.75 |
| 28 | 33 | 50 | 32 | 1.2 | 1.52 | 1.56 |
| 29 | 48 | 83 | 32 | 1.8 | 1.73 | 2.59 |
| 30 | 53 | 80 | 33 | 2.1 | 1.51 | 2.42 |
| 31 | 52 | 90 | 45 | 2.9 | 1.73 | 2.00 |
| 32 | 37 | 60 | 51 | 3.4 | 1.62 | 1.18 |
| 33 | 15 | 16 | 10 | 1.2 | 1.07 | 1.60 |
| 34 | 25 | 40 | 19 | 2.2 | 1.60 | 2.11 |
| 35 | 45 | 50 | 23 | 1.7 | 1.11 | 2.17 |
| 36 | 22 | 35 | 31 | 1.8 | 1.59 | 1.13 |
| 37 | 36 | 55 | 40 | 1.5 | 1.53 | 1.38 |
| 38 | 41 | 57 | 34 | 1 | 1.39 | 1.68 |
| 39 | 78 | 90 | 46 | 2.1 | 1.15 | 1.96 |
| 40 | 18 | 28 | 20 | 1.1 | 1.56 | 1.40 |
| 41 | 12 | 19 | 16 | 1.8 | 1.58 | 1.19 |
| 42 | 79 | 80 | 72 | 2 | 1.01 | 1.11 |
| 43 | 75 | 110 | 100 | 3.6 | 1.47 | 1.10 |
| 44 | 57 | 80 | 74 | 2.9 | 1.40 | 1.08 |
| 45 | 40 | 50 | 15 | 0.9 | 1.25 | 3.33 |
| 46 | 41 | 60 | 16 | 2.9 | 1.46 | 3.75 |
| 47 | 10 | 16 | 4 | 1.5 | 1.60 | 4.00 |
| 48 | 26 | 32 | 12 | 1.2 | 1.23 | 2.67 |
| 49 | 21 | 22 | 19 | 2.9 | 1.05 | 1.16 |

TABLE 2-1-continued

| Example | Height difference (μm) | Max. diam. (μm) | Mini. diam. of openings (μm) | Diff. betwn outer diam. and inner diam. (μm) | (Max. diam.)/(height diff.) | (Max. diam.)/(mini. diam. of openings) |
|---|---|---|---|---|---|---|
| 50 | 5.4 | 5.0 | 4 | 1.8 | 0.93 | 1.25 |
| 51 | 16 | 17 | 14 | 3.5 | 1.06 | 1.21 |
| 52 | 11 | 11 | 3 | 3.2 | 1.00 | 3.67 |
| 53 | 5.1 | 5.0 | 2 | 2.1 | 0.98 | 2.50 |

TABLE 2-2

| Comparative Example | Height difference (μm) | Max. diam. (μm) | Mini. diam. of openings (μm) | Diff. betwn outer diam. and inner diam. (μm) | (Max. diam.)/(height diff.) | (Max. diam.)/(mini. diam. of openings) |
|---|---|---|---|---|---|---|
| 1 | 50 | 110 | 106 | 2.1 | 2.20 | 1.04 |
| 2 | 45 | 110 | 107 | 1.5 | 2.44 | 1.03 |
| 3 | 58 | 115 | 111 | 1.8 | 1.98 | 1.04 |
| 4 | 55 | 105 | 102 | 1.5 | 1.91 | 1.03 |
| 5 | — | — | — | — | — | — |
| 6 | — | — | — | — | — | — |
| 7 | 60 | 80 | 74 | 3.1 | 1.33 | 1.08 |
| 8 | — | — | — | — | — | — |
| 9 | — | — | — | — | — | — |

TABLES 3-1

| | Running evaluation 1 | | | | | | | | | | | |
|---|---|---|---|---|---|---|---|---|---|---|---|---|
| | 15° C./10% RH environment | | | | 23° C./50% RH environment | | | | 32.5° C./80% RH environment | | | |
| Example | 18k | 24k | 30k | 36k | 18k | 24k | 30k | 36k | 18k | 24k | 30k | 36K |
| 1 | 1 | 1 | 1 | 1 | 1 | 1 | 1 | 1 | 1 | 1 | 1 | 1 |
| 2 | 1 | 1 | 2 | 2 | 1 | 1 | 1 | 2 | 1 | 1 | 2 | 2 |
| 3 | 1 | 1 | 1 | 1 | 1 | 1 | 1 | 1 | 1 | 1 | 1 | 1 |
| 4 | 1 | 1 | 2 | 3 | 1 | 1 | 3 | 3 | 1 | 2 | 3 | 3 |
| 5 | 1 | 1 | 2 | 2 | 1 | 1 | 2 | 2 | 1 | 1 | 2 | 2 |
| 6 | 1 | 1 | 1 | 1 | 1 | 1 | 1 | 2 | 1 | 2 | 3 | 3 |
| 7 | 1 | 1 | 2 | 2 | 1 | 1 | 2 | 2 | 1 | 1 | 2 | 2 |
| 8 | 1 | 1 | 1 | 1 | 1 | 1 | 1 | 1 | 1 | 1 | 1 | 1 |
| 9 | 1 | 1 | 2 | 2 | 1 | 1 | 1 | 2 | 1 | 1 | 2 | 2 |
| 10 | 1 | 1 | 2 | 2 | 1 | 1 | 1 | 2 | 1 | 1 | 2 | 2 |
| 11 | 1 | 1 | 1 | 1 | 1 | 1 | 1 | 2 | 1 | 1 | 1 | 2 |
| 12 | 1 | 1 | 1 | 1 | 1 | 1 | 1 | 1 | 1 | 1 | 1 | 1 |
| 13 | 1 | 1 | 2 | 2 | 1 | 1 | 2 | 2 | 1 | 1 | 2 | 2 |
| 14 | 1 | 1 | 2 | 2 | 1 | 1 | 2 | 2 | 1 | 1 | 2 | 2 |
| 15 | 1 | 1 | 2 | 3 | 1 | 1 | 1 | 3 | 1 | 1 | 2 | 3 |
| 16 | 1 | 1 | 2 | 2 | 1 | 1 | 2 | 2 | 1 | 1 | 2 | 2 |
| 17 | 1 | 1 | 2 | 3 | 1 | 1 | 1 | 2 | 1 | 1 | 3 | 3 |
| 18 | 1 | 1 | 2 | 2 | 1 | 1 | 1 | 2 | 1 | 1 | 1 | 2 |
| 19 | 1 | 1 | 1 | 1 | 1 | 1 | 1 | 1 | 1 | 1 | 1 | 1 |
| 20 | 1 | 1 | 1 | 2 | 1 | 1 | 2 | 2 | 1 | 1 | 2 | 2 |
| 21 | 1 | 1 | 2 | 3 | 1 | 1 | 2 | 3 | 1 | 1 | 2 | 3 |
| 22 | 1 | 1 | 1 | 1 | 1 | 1 | 1 | 1 | 1 | 1 | 1 | 1 |
| 23 | 1 | 1 | 1 | 1 | 1 | 1 | 1 | 1 | 1 | 1 | 1 | 1 |
| 24 | 1 | 2 | 2 | 2 | 1 | 2 | 2 | 2 | 1 | 2 | 2 | 2 |
| 25 | 1 | 1 | 1 | 2 | 1 | 1 | 1 | 2 | 1 | 1 | 1 | 2 |
| 26 | 2 | 2 | 3 | 3 | 2 | 2 | 3 | 3 | 2 | 3 | 3 | 3 |
| 27 | 1 | 1 | 1 | 2 | 1 | 1 | 1 | 2 | 1 | 1 | 1 | 2 |
| 28 | 1 | 1 | 1 | 2 | 1 | 1 | 1 | 2 | 1 | 1 | 1 | 2 |
| 29 | 1 | 1 | 1 | 2 | 1 | 1 | 1 | 2 | 1 | 1 | 1 | 2 |
| 30 | 1 | 2 | 2 | 2 | 1 | 2 | 2 | 2 | 1 | 2 | 2 | 2 |
| 31 | 1 | 2 | 2 | 2 | 1 | 1 | 2 | 2 | 1 | 2 | 2 | 2 |
| 32 | 1 | 2 | 3 | 3 | 1 | 1 | 2 | 3 | 1 | 1 | 2 | 3 |
| 33 | 2 | 2 | 3 | 3 | 2 | 2 | 3 | 3 | 2 | 2 | 3 | 3 |
| 34 | 1 | 2 | 2 | 2 | 1 | 2 | 2 | 2 | 1 | 2 | 2 | 2 |
| 35 | 1 | 2 | 2 | 2 | 1 | 1 | 2 | 2 | 1 | 2 | 2 | 2 |
| 36 | 1 | 2 | 2 | 3 | 1 | 2 | 3 | 3 | 2 | 2 | 3 | 3 |
| 37 | 2 | 2 | 2 | 2 | 2 | 2 | 2 | 2 | 2 | 2 | 2 | 2 |
| 38 | 1 | 1 | 1 | 2 | 1 | 1 | 1 | 2 | 1 | 1 | 1 | 2 |
| 39 | 1 | 2 | 2 | 2 | 1 | 2 | 2 | 2 | 1 | 1 | 2 | 2 |
| 40 | 1 | 1 | 2 | 2 | 1 | 1 | 2 | 2 | 1 | 1 | 2 | 2 |

TABLES 3-1-continued

| | | | | | | | | | | | | |
|---|---|---|---|---|---|---|---|---|---|---|---|---|
| 41 | 1 | 2 | 3 | 3 | 1 | 2 | 3 | 3 | 1 | 2 | 3 | 3 |
| 42 | 2 | 2 | 2 | 2 | 2 | 2 | 2 | 2 | 2 | 2 | 2 | 2 |
| 43 | 2 | 3 | 3 | 3 | 2 | 3 | 3 | 3 | 2 | 3 | 3 | 3 |
| 44 | 2 | 3 | 3 | 3 | 2 | 3 | 3 | 3 | 2 | 3 | 3 | 3 |
| 45 | 1 | 1 | 1 | 2 | 1 | 1 | 1 | 2 | 1 | 1 | 1 | 2 |
| 46 | 2 | 2 | 2 | 2 | 2 | 2 | 2 | 2 | 2 | 2 | 2 | 2 |
| 47 | 2 | 2 | 3 | 3 | 2 | 2 | 3 | 3 | 2 | 2 | 3 | 3 |
| 48 | 1 | 1 | 1 | 2 | 1 | 1 | 1 | 2 | 1 | 1 | 1 | 2 |
| 49 | 1 | 1 | 1 | 1 | 1 | 1 | 1 | 2 | 1 | 1 | 1 | 2 |
| 50 | 2 | 2 | 3 | 3 | 2 | 2 | 3 | 3 | 2 | 2 | 3 | 3 |
| 51 | 2 | 2 | 2 | 2 | 2 | 2 | 2 | 2 | 2 | 2 | 2 | 2 |
| 52 | 1 | 2 | 2 | 2 | 1 | 2 | 2 | 2 | 1 | 2 | 2 | 2 |
| 53 | 2 | 2 | 3 | 3 | 1 | 2 | 3 | 3 | 2 | 3 | 3 | 3 |

| | Running evaluation 2 | | | | | | | | | | | |
|---|---|---|---|---|---|---|---|---|---|---|---|---|
| | 15° C./10% RH environment | | | | 23° C./50% RH environment | | | | 32.5° C./80% RH environment | | | |
| Example | 6k | 9k | 12k | 15K | 6k | 9k | 12k | 15k | 6k | 9k | 12k | 15k |
| 1 | 1 | 1 | 1 | 1 | 1 | 1 | 1 | 1 | 1 | 1 | 1 | 1 |
| 2 | 1 | 1 | 2 | 2 | 1 | 1 | 1 | 1 | 1 | 1 | 1 | 2 |
| 3 | 1 | 1 | 1 | 1 | 1 | 1 | 1 | 1 | 1 | 1 | 1 | 1 |
| 4 | 1 | 1 | 2 | 3 | 1 | 1 | 1 | 2 | 1 | 1 | 2 | 3 |
| 5 | 1 | 1 | 2 | 2 | 1 | 1 | 1 | 1 | 1 | 1 | 1 | 1 |
| 6 | 1 | 1 | 1 | 2 | 1 | 1 | 1 | 2 | 1 | 1 | 1 | 1 |
| 7 | 1 | 1 | 2 | 2 | 1 | 1 | 1 | 2 | 1 | 1 | 1 | 2 |
| 8 | 1 | 1 | 1 | 1 | 1 | 1 | 1 | 1 | 1 | 1 | 1 | 1 |
| 9 | 1 | 1 | 2 | 2 | 1 | 1 | 1 | 1 | 1 | 1 | 1 | 1 |
| 10 | 1 | 1 | 2 | 2 | 1 | 1 | 1 | 2 | 1 | 1 | 1 | 2 |
| 11 | 1 | 1 | 1 | 2 | 1 | 1 | 1 | 2 | 1 | 1 | 1 | 2 |
| 12 | 1 | 1 | 1 | 1 | 1 | 1 | 1 | 1 | 1 | 1 | 1 | 4 |
| 13 | 1 | 1 | 2 | 2 | 1 | 1 | 1 | 2 | 1 | 1 | 1 | 2 |
| 14 | 1 | 1 | 2 | 2 | 1 | 1 | 1 | 2 | 1 | 1 | 1 | 2 |
| 15 | 1 | 1 | 2 | 3 | 1 | 1 | 2 | 3 | 1 | 1 | 2 | 3 |
| 16 | 1 | 1 | 2 | 2 | 1 | 1 | 1 | 2 | 1 | 1 | 1 | 2 |
| 17 | 1 | 1 | 2 | 2 | 1 | 1 | 2 | 3 | 1 | 1 | 1 | 2 |
| 18 | 1 | 1 | 1 | 2 | 1 | 1 | 1 | 2 | 1 | 1 | 1 | 2 |
| 19 | 1 | 1 | 1 | 1 | 1 | 1 | 1 | 1 | 1 | 1 | 1 | 1 |
| 20 | 1 | 2 | 2 | 2 | 1 | 1 | 2 | 2 | 1 | 1 | 1 | 2 |
| 21 | 1 | 1 | 2 | 3 | 1 | 1 | 2 | 2 | 1 | 1 | 2 | 2 |
| 22 | 1 | 1 | 1 | 1 | 1 | 1 | 1 | 1 | 1 | 1 | 1 | 1 |
| 23 | 1 | 1 | 1 | 1 | 1 | 1 | 1 | 1 | 1 | 1 | 1 | 1 |
| 24 | 1 | 2 | 2 | 2 | 1 | 1 | 2 | 2 | 1 | 1 | 2 | 2 |
| 25 | 1 | 1 | 2 | 2 | 1 | 1 | 1 | 1 | 1 | 1 | 1 | 1 |
| 26 | 1 | 2 | 3 | 3 | 1 | 2 | 3 | 3 | 1 | 2 | 3 | 3 |
| 27 | 1 | 1 | 2 | 2 | 1 | 1 | 1 | 2 | 1 | 1 | 1 | 1 |
| 28 | 1 | 1 | 1 | 1 | 1 | 1 | 1 | 1 | 1 | 1 | 1 | 1 |
| 29 | 1 | 1 | 1 | 2 | 1 | 1 | 1 | 2 | 1 | 1 | 1 | 2 |
| 30 | 1 | 2 | 2 | 2 | 1 | 1 | 2 | 2 | 1 | 1 | 2 | 2 |
| 31 | 1 | 2 | 2 | 2 | 1 | 1 | 2 | 2 | 1 | 1 | 2 | 2 |
| 32 | 1 | 1 | 2 | 3 | 1 | 1 | 2 | 2 | 1 | 1 | 2 | 2 |
| 33 | 1 | 1 | 2 | 3 | 1 | 1 | 2 | 2 | 1 | 1 | 2 | 2 |
| 34 | 1 | 1 | 2 | 2 | 1 | 1 | 2 | 2 | 1 | 1 | 2 | 2 |
| 35 | 1 | 2 | 2 | 2 | 1 | 1 | 2 | 2 | 1 | 1 | 2 | 2 |
| 36 | 2 | 2 | 2 | 2 | 2 | 2 | 2 | 2 | 2 | 2 | 2 | 2 |
| 37 | 2 | 2 | 2 | 2 | 2 | 2 | 2 | 2 | 2 | 2 | 2 | 2 |
| 38 | 1 | 1 | 2 | 2 | 1 | 1 | 1 | 2 | 1 | 1 | 1 | 2 |
| 39 | 2 | 2 | 2 | 2 | 2 | 2 | 2 | 2 | 2 | 2 | 2 | 2 |
| 40 | 1 | 1 | 2 | 2 | 1 | 1 | 1 | 2 | 1 | 1 | 2 | 2 |
| 41 | 1 | 2 | 2 | 3 | 1 | 2 | 2 | 3 | 1 | 2 | 2 | 3 |
| 42 | 1 | 2 | 2 | 3 | 1 | 2 | 2 | 2 | 1 | 2 | 2 | 2 |
| 43 | 2 | 3 | 3 | 3 | 2 | 2 | 3 | 3 | 2 | 2 | 3 | 3 |
| 44 | 2 | 3 | 3 | 3 | 2 | 3 | 3 | 3 | 2 | 2 | 3 | 3 |
| 45 | 1 | 1 | 1 | 2 | 1 | 1 | 1 | 2 | 1 | 1 | 1 | 1 |
| 46 | 2 | 2 | 2 | 2 | 2 | 2 | 2 | 2 | 2 | 2 | 2 | 2 |
| 47 | 1 | 1 | 2 | 3 | 1 | 1 | 2 | 3 | 1 | 1 | 2 | 3 |
| 48 | 1 | 1 | 1 | 2 | 1 | 1 | 1 | 2 | 1 | 1 | 1 | 2 |
| 49 | 1 | 1 | 1 | 1 | 1 | 1 | 1 | 1 | 1 | 1 | 1 | 1 |
| 50 | 1 | 2 | 2 | 3 | 1 | 2 | 3 | 3 | 1 | 2 | 3 | 3 |
| 51 | 1 | 1 | 1 | 1 | 1 | 1 | 1 | 1 | 1 | 1 | 1 | 1 |
| 52 | 1 | 1 | 1 | 2 | 1 | 1 | 1 | 1 | 1 | 1 | 1 | 2 |
| 53 | 1 | 1 | 2 | 3 | 1 | 1 | 1 | 2 | 1 | 1 | 1 | 2 |

k: ×1,000 sheets

TABLES 3-2

| Cp. | Running evaluation 1 | | | | | | | | | | | |
|---|---|---|---|---|---|---|---|---|---|---|---|---|
| | 15° C./10% RH environment | | | | 23° C./50% RH environment | | | | 32.5° C./80% RH environment | | | |
| Example | 18k | 24k | 30K | 36k | 18k | 24k | 30k | 36k | 18k | 24k | 30k | 36k |
| 1 | 4 | 4 | 4 | 4 | 3 | 4 | 4 | 4 | 4 | 4 | 4 | 4 |
| 2 | 3 | 3 | 4 | 4 | 3 | 3 | 4 | 4 | 3 | 4 | 4 | 4 |
| 3 | 3 | 3 | 4 | 4 | 3 | 3 | 4 | 4 | 3 | 4 | 4 | 4 |
| 4 | 3 | 4 | 4 | 4 | 3 | 4 | 4 | 4 | 3 | 4 | 4 | 4 |
| 5 | 3 | 3 | 4 | 4 | 3 | 3 | 4 | 4 | 3 | 4 | 4 | 4 |
| 6 | 4 | 4 | 4 | 4 | 4 | 4 | 4 | 4 | 4 | 4 | 4 | 4 |
| 7 | 4 | 4 | 4 | 4 | 4 | 4 | 4 | 4 | 4 | 4 | 4 | 4 |
| 8 | 3 | 3 | 4 | 4 | 3 | 3 | 4 | 4 | 3 | 3 | 4 | 4 |
| 9 | 3 | 4 | 4 | 4 | 3 | 4 | 4 | 4 | 3 | 4 | 4 | 4 |

| Cp. | Running evaluation 2 | | | | | | | | | | | |
|---|---|---|---|---|---|---|---|---|---|---|---|---|
| | 15° C./10% RH environment | | | | 23° C./50% RH environment | | | | 32.5° C./80% RH environment | | | |
| Example | 6k | 9k | 12k | 15K | 6k | 9K | 12k | 15k | 6k | 9k | 12k | 15k |
| 1 | 4 | 4 | 4 | 4 | 4 | 4 | 4 | 4 | 4 | 4 | 4 | 4 |
| 2 | 3 | 3 | 4 | 4 | 3 | 3 | 4 | 4 | 2 | 3 | 4 | 4 |
| 3 | 3 | 3 | 4 | 4 | 2 | 3 | 4 | 4 | 2 | 3 | 4 | 4 |
| 4 | 3 | 4 | 4 | 4 | 3 | 4 | 4 | 4 | 3 | 3 | 4 | 4 |
| 5 | 4 | 4 | 4 | 4 | 3 | 4 | 4 | 4 | 3 | 4 | 4 | 4 |
| 6 | 4 | 4 | 4 | 4 | 2 | 3 | 3 | 4 | 2 | 3 | 3 | 4 |
| 7 | 4 | 4 | 4 | 4 | 2 | 3 | 4 | 4 | 2 | 3 | 4 | 4 |
| 8 | 3 | 3 | 4 | 4 | 3 | 3 | 3 | 3 | 3 | 3 | 3 | 3 |
| 9 | 2 | 2 | 2 | 3 | 2 | 2 | 2 | 3 | 2 | 2 | 2 | 3 |

Cp.: Comparative
k: ×1,000 sheets

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-105842, filed Apr. 30, 2010, which is hereby incorporated by reference herein in its entirety.

What is claimed is:

1. A charging member comprising a conductive substrate and a conductive resin layer;

the conductive resin layer comprising:

a binder, conductive fine particles, and bowl-shaped resin particles each of which has an opening, wherein the bowl-shaped resin particles are contained in the conductive resin layer in such a way as not to be exposed to an outer surface of the charging member, the surface of the charging member has concavities derived from the openings of the bowl-shaped resin particles and protrusions derived from edges of the openings of the bowl-shaped resin particles, each of the bowl-shaped resin particles has a roundish concavity, the bowl-shaped resin particles include inner walls lined with the conductive resin layer, and a top-to-bottom distance between each top of the protrusions derived from the openings of the bowl-shaped resin particles and a corresponding bottom of the concavities derived from the openings of the bowl-shaped particles ranges from 5 μm or more to 100 μm or less.

2. The charging member according to claim 1, wherein the top-to-bottom distance ranges from 8 μm or more to 80 μm or less.

3. The charging member according to claim 1, wherein a ratio of a maximum diameter of each of the bowl-shaped resin particles to the top-to-bottom distance is from 0.8 or more to 3.0 or less.

4. The charging member according to claim 1, wherein the bowl-shaped resin particles have a maximum diameter of from 5 μm or more to 150 μm or less.

5. The charging member according to claim 4, wherein the bowl-shaped resin particles have a maximum diameter of from 8 μm or more to 120 μm or less.

6. The charging member according to claim 1, wherein a ratio of a maximum diameter in each of the bowl-shaped resin particles to a minimum diameter of each of the openings is from 1.1 or more to 4.0 or less.

7. The charging member according to claim 1, wherein peripheral edges of the openings of the bowl-shaped resin particles have a difference between outer diameter and inner diameter of from 0.1 μm or more to 3 μm or less.

8. The charging member according to claim 7, wherein the peripheral edges of the openings of the bowl-shaped resin particles have a difference between outer diameter and inner diameter of from 0.2 μm or more to 2 μm or less.

9. The charging member according to claim 8, wherein the difference is formed substantially uniformly over an entire length of each bowl-shaped resin particle.

10. A process cartridge comprising:

the charging member according to claim 1, and an electrically chargeable body provided in contact with the charging member, both of which are integrally joined, the process cartridge being so constituted as to be detachably mountable to the main body of an electrophotographic apparatus.

11. An electrophotographic apparatus comprising the charging member according to claim 1, an exposure unit, and a developing assembly.

12. A charging member comprising a conductive substrate and a conductive resin layer;

the conductive resin layer comprising:

a binder, conductive fine particles, and bowl-shaped resin particles each of which has an opening, wherein the bowl-shaped resin particles are contained in the conductive resin layer in such a way as not to be exposed to an outer surface of the charging member, the surface of the charging member has concavities derived from the openings of the bowl-shaped resin particles and protrusions derived from edges of the openings of the bowl-shaped resin particles, the bowl-shaped resin particles are formed to have a concave-shaped inner wall and a convex-shaped outer wall, and peripheral edges of the openings of the bowl-shaped resin s articles have a difference between an outer diameter and an inner diameter of from 0.1 μm or more to 3 μm or less.

13. The charging member according to claim 12, wherein the peripheral edges of the openings of the bowl-shaped resin particles have the difference between the outer diameter and the inner diameter of from 0.2 μm or more to 2 μm or less.

14. The charging member according to claim 13, wherein the difference is formed substantially uniformly over an entire length of each bowl-shaped resin particle.

15. The charging member according to claim 12, wherein a top-to-bottom distance between each top of the protrusions derived from the edges of the openings of the bowl-shaped particles and a corresponding bottom of the concavities derived from the openings of the bowl-shaped particles ranges from 5 μm or more to 100 μm or less.

16. The charging member according to claim 15, wherein the top-to-bottom distance ranges from 8 μm or more to 80 μm or less.

17. The charging member according to claim 12, wherein a ratio of a maximum diameter of each of the bowl-shaped resin particles to the top-to-bottom distance is from 0.8 or more to 3.0 or less.

18. The charging member according to claim 12, wherein a ratio of a maximum diameter of each of the bowl-shaped resin particles to a minimum diameter of each of the openings is from 1.1 or more to 4.0 or less.

* * * * *